US006501347B1

(12) United States Patent
Ono et al.

(10) Patent No.: US 6,501,347 B1
(45) Date of Patent: Dec. 31, 2002

(54) DIELECTRIC FILTER HAVING FORKED AUXILIARY CONDUCTOR

(75) Inventors: Shoji Ono, Nagoya (JP); Kenji Ito, Nagoya (JP); Naomasa Wakita, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 43 days.

(21) Appl. No.: 09/652,016

(22) Filed: Aug. 31, 2000

(30) Foreign Application Priority Data

Sep. 24, 1999 (JP) ..... 11-270667
Dec. 1, 1999 (JP) ..... 11-342222

(51) Int. Cl.[7] ..... H01P 1/20; H01P 1/205
(52) U.S. Cl. ..... 333/202; 333/206
(58) Field of Search ..... 333/202, 206, 333/204

(56) References Cited

U.S. PATENT DOCUMENTS

| | | | | |
|---|---|---|---|---|
| 4,673,902 A | | 6/1987 | Takeda et al. | |
| 4,985,690 A | * | 1/1991 | Eguchi et al. | 333/222 |
| 5,331,300 A | | 7/1994 | Shimizu et al. | |
| 5,684,439 A | * | 11/1997 | Vangala | 333/202 |
| 5,696,473 A | | 12/1997 | Tsujiguchi et al. | |
| 5,793,267 A | * | 8/1998 | Tada et al. | 333/202 |
| 5,929,721 A | * | 7/1999 | Munn et al. | 333/134 |
| 6,023,207 A | | 2/2000 | Ito et al. | |

FOREIGN PATENT DOCUMENTS

| | | |
|---|---|---|
| EP | 0 336 255 A1 | 10/1989 |
| EP | 0 635 897 A1 | 1/1995 |
| EP | 0 809 315 A1 | 11/1997 |
| EP | 0 837 519 A1 | 4/1998 |
| JP | 60152012 A | 8/1985 |
| JP | Sho 62-103302 | 5/1987 |
| JP | 04360301 | 12/1992 |
| JP | 05226917 A | 9/1993 |
| JP | Hei-7-283604 | 10/1995 |
| JP | 09064616 A | 3/1997 |
| JP | 09252202 A | 9/1997 |
| JP | 11068407 A | 3/1999 |
| JP | 2936443 | 8/1999 |

* cited by examiner

*Primary Examiner*—Benny T. Lee
*Assistant Examiner*—Damian Cathey
(74) *Attorney, Agent, or Firm*—Larson & Taylor, PLC

(57) ABSTRACT

A dielectric filter includes a dielectric ceramic block having the shape of a rectangular prism and including three or more through-holes formed therein in parallel. An inner conductor covers the inner surface of each of the through-holes to form the corresponding resonator. An outer conductor covers a predetermined outer surface of the dielectric ceramic block, excluding the open end surface. Input/output pads are formed on one side surface of the dielectric ceramic block such that the pads face the two end resonators. Each of the through-holes of the end resonators is provided with a counterbore. An auxiliary conductor is disposed on the open end surface to face at least one intermediate resonator between end resonators. The auxiliary conductor at least partially surrounds the intermediate resonator with an insulating gap formed therebetween, and is connected to the outer conductor on the side surface on which the input/output pads are provided. The auxiliary conductor is formed by a conductive material disposed in a concave portion formed in the open end surface and having a pattern corresponding to the pattern of the auxiliary conductor.

6 Claims, 19 Drawing Sheets

DIELECTRIC FILTER HAVING FORKED AUXILIARY CONDUCTOR

BACKGROUND OF THE INVENTION

1. Field of the Invention

The present invention relates to a dielectric filter having an auxiliary conductor of a predetermined pattern which is provided on an open end surface and is electrically connected to an outer conductor provided on a side surface. The present invention also relates to a method of manufacturing such a dielectric filter.

2. Description of the Related Art

There are known various kinds of dielectric filters in which the inner surfaces of through-holes extending through a dielectric ceramic block are coated with conductive material forming inner conductors so as to produce a plurality of resonators disposed in parallel, and in which the outer surface of the dielectric ceramic block is coated with a conductive material forming an outer conductor, except for an open end surface at which one end of each of the through-holes opens.

Further, a dielectric filter having an improved structure is disclosed in Japanese Utility Model Publication (kokoku) No. 4-8643. As shown in FIG. 1 which is based on the disclosure of that publication, in the improved dielectric filter, strip-shaped or strip-form auxiliary conductors f, i.e., conductor strips, are formed on the open end surface d such that one auxiliary conductor f is located between resonators a and b, the other auxiliary conductor f is located between resonators b and c, and the auxiliary conductors f are electrically connected to an outer conductor e formed on the outer surface. Due to formation of the strip-form conductors f, the frequency characteristic of the resultant dielectric filter exhibits an attenuation peak on the higher frequency side with respect to the center frequency. Through modification and adjustment of the shape and the width of the auxiliary conductors f, the mutual electromagnetic coupling between the resonators a and b and between the resonators b and c can be adjusted.

In addition, as shown in FIG. 2, in the dielectric filter disclosed in Japanese Patent Application Laid-Open (kokai) No. 9-219605, a counterbore h is formed at the end of a through-hole g that opens at the open end surface d, such that the diameter of the counterbore h increases at the open end; and an inner conductor j covering the inner surface of the counterbore h is extended inwardly in the radial direction, to thereby increase the effective resonance length. An advantage of this structure is that the overall length of the dielectric filter is decreased as compared with a conventional dielectric filter having the same resonance length.

It will be appreciated that, depending on the purpose or use to which a dielectric filter is to be put, there is a demand for various different types of dielectric filters having different shapes and characteristics. In this regard, there is a demand for a dielectric filter which exhibits a filter characteristic having an attenuation peak on the higher frequency side thereof and which can be made compact. Such a dielectric filter can be produced by combining the filter structure shown in FIG. 1 in which the strip-form conductors f are formed such that the filter characteristic has a particular attenuation peak, and the filter structure shown in FIG. 2 in which the overall length is shortened through formation of the counterbore h. However, in this case, because both the strip-shaped or strip-form conductors f and the counterbore h must be formed on the same open end surface, the simultaneous formation of the strip-shaped conductors f and the counterbore h on this surface is difficult because the surface is limited in area.

Moreover, the basic dielectric filter shown in FIG. 1 has a particular drawback. Specifically, the auxiliary conductors f and the outer conductor e are formed through a process in which a conductive material in the form of paste is applied, by means of screen printing, to each surface of the dielectric ceramic block in a predetermined pattern, followed by a baking step carried out at a predetermined temperature. In order to provide the required connections between the auxiliary conductors f on the open end surface d and the outer conductor e on the outer surface, the conductive paste material must be applied such that a conductive material layer on the open end surface and the conductive material layer on a selected side surface must overlap each other at an edge portion where the open end surface and the selected side surface intersect each other, so as to ensure that a mutual connection is established between the conductive material layers. However, since each layer of applied conductive material is very thin and becomes thinner at the edge portion due to surface tension of the conductive material, when the baking step is carried out, the thin portion of the conductive material layer located at the edge portion of the block can easily break due to the difference in the thermal expansion coefficients between the dielectric ceramic block and the conductive material, with the result that such electrode breakage can occur at the edge portion.

The above-described drawback of the layer of applied conductive material, i.e., the fact that the layer becomes thinner at the edge portion due to surface tension, can be overcome by manually applying the conductive material to the edge portion after completion of screen printing to thereby increase the thickness of the layer to a desired level. Since a manual operation is difficult and time consuming, and manufacturing efficiency is low, with the result that the abovementioned solution is simply not practical.

Moreover, in the conventional dielectric filter, when the auxiliary conductors f are formed, a conductive material in the form of paste is screen-printed on the flat open end surface. Therefore, the conductive material easily runs and spreads, which makes accurate formation of the auxiliary conductor f impossible as a practical matter.

SUMMARY OF THE INVENTION

In view of the foregoing, a first object of the present invention is to provide a dielectric filter which has a shortened overall length and which can be made to exhibit a peak in the filter characteristic thereof on the higher-frequency side with respect to the center frequency.

Another object of the present invention is to provide a dielectric filter which has a structure that prevents electrode breakage which would otherwise occur at an edge portion, as described above, and which also enables the accurate formation of auxiliary conductors in a desired pattern.

Still another object of the present invention is to provide a method of manufacturing a dielectric filter, which method prevents electrode breakage which would otherwise occur at an edge portion and enables the accurate formation of auxiliary conductors in a desired pattern.

According to a first aspect of the invention, there is provided a dielectric filter including at least three resonators, the filter comprising: a dielectric ceramic block having at least three through-holes formed therein, in parallel, in a group having opposite ends, each of the through-holes including an inner surface, and the at least three through-holes including end through-holes located at opposite ends of the group and at least one intermediate through-hole located between the end through-holes, the dielectric ceramic block including an open end surface at which one end of each of said through-holes opens; an inner conductor covering the inner surface of each of the through-holes to respectively form corresponding end resonators and at least one intermediate resonator; an outer conductor covering a predetermined outer surface of the dielectric ceramic block, excluding said open end surface; and input/output pads formed on one side surface of the dielectric ceramic block such that the pads are located near the open end surface and face the end resonators so as to be capacatively coupled thereto, each of the end through-holes including a counterbore formed at one end of the corresponding end through-hole and opening at the open end surface such that the corresponding end through-hole is of increased diameter at said one end; and the filter further comprising an auxiliary conductor disposed on the open end surface so as to face said at least one intermediate resonator, the auxiliary conductor being of forked shape and having at least two branch portions, each of the branch portions being located between adjacent resonators, and the auxiliary conductor at least partially surrounding the at least one intermediate resonator with an insulating gap formed therebetween, and the auxiliary conductor being connected to a portion of the outer conductor located on the one side surface on which the input/output pads are formed.

In this aspect of the invention, each of the end through-holes includes a counterbore at one end of the corresponding through-hole which opens at the open end surface and thus the corresponding through-hole is of an increased diameter at the one end. As a consequence, the inner conductor covering the inner surface of the counterbore extends inwardly in the radial direction, so that the effective resonance length is increased. Thus, the lengths of the end resonators can be shortened and still provide the same resonance characteristics.

Further, because for at least one resonator other than the end resonators, an auxiliary conductor connected to the outer conductor on the side surface is disposed such that the auxiliary conductor at least partially surrounds the at least one resonator with an insulating gap formed therebetween, a capacitance (C) is produced between the auxiliary conductor and the inner conductor of the at least one resonator, and as will be described later, the length of the at least one resonator can be shortened by an amount related to the value of the capacitance C. Accordingly, the resonance length of the at least one resonator can be made to be the same as that of the end resonators by adjustment of the capacitance C to a desired value through adjustment of the insulating gap and the length of the arcuate edge portion of the auxiliary conductor surrounding the at least one resonator. Thus, the overall length of the dielectric filter can be correspondingly shortened. Further, the resultant dielectric filter has a frequency characteristic which exhibits an attenuation peak on the higher-frequency side of the center frequency.

Preferably, the auxiliary conductor has an open configuration including an opening which opens toward the side surface opposite to that on which the input/output pads are formed; and a second auxiliary conductor extends toward the opening from a portion of the outer conductor located on that opposite side surface, such that the inner edge of the second auxiliary conductor faces the corresponding resonator with an insulating gap formed therebetween. In this case, an additional capacitance is produced between the second auxiliary conductor and the inner conductor of the corresponding resonator, so that the overall capacitance C can be increased.

In one embodiment of the dielectric filter according to this first aspect of the present invention, a trap resonator is disposed at one end of the dielectric ceramic block such that the trap resonator is located adjacent to at least one of the end resonators. The inner surface of the through-hole of the trap resonator is covered with an inner conductor, and a counterbore is formed at one end of the through-hole which opens at the open end surface so that the diameter of the through-hole is increased at the one end. In this case, a trap effect is produced at a self-resonance frequency outside the pass band, whereby spurious signals can be attenuated to provide elimination thereof.

According to a second aspect of the invention, there is provided a dielectric filter including a plurality of resonators, the filter comprising: a dielectric ceramic block including a plurality of through-holes formed therein in parallel, said through-holes including an inner surface and the dielectric ceramic block having an open end surface at which one end of each of said through-holes opens; an inner conductor covering the inner surface of each of the through-holes to thereby form a corresponding resonator; an outer conductor covering a predetermined outer surface of the dielectric ceramic block, excluding the open end surface; and an auxiliary conductor formed on the open end surface in a predetermined pattern, the auxiliary conductor being electrically connected to a portion of the outer conductor located on one side surface of the dielectric ceramic block, the auxiliary conductor comprising a conductive material disposed in a concave portion formed in the open end surface of said block in a pattern corresponding to the pattern of the auxiliary conductor.

In this aspect of the invention, because the shape of the conductive material is defined by the concave portion, i.e., flow of the conductive material is restricted by the concave portion, the conductive material neither runs nor spreads. Thus, the auxiliary conductor can be accurately formed in a desired pattern.

According to the second aspect of the present invention, there is further provided a method of manufacturing a dielectric filter, the method comprising the steps of: press forming ceramic powder to produce a green body having a shape of a substantially rectangular prism and including a concave portion of a predetermined shape formed in an end surface of the prism; sintering the green body to obtain a dielectric ceramic block; disposing a conductive material paste form in the concave portion; applying a conductive material onto a predetermined outer surface of the dielectric ceramic block excluding said end surface; and baking said conductive material to form an outer conductor on the predetermined outer surface of the dielectric ceramic block excluding said end surface so that said end surface serves as an open end surface of the filter and to form an auxiliary conductor in the concave portion of the end surface such that an outer end of the auxiliary conductor is electrically connected to a portion of the outer conductor located on one side surface of the dielectric ceramic block.

When this method is used, a concave portion of predetermined shape can readily be formed in the green body simultaneously with formation of the green body, by using a mold which has on the inner surface thereof a projecting portion corresponding to the concave portion.

In the method set forth above, when a conductive paste material is used to fill the concave portion formed on the open end surface to a thickness corresponding to the depth of the concave portion, the outer end surface of the layer of the conductive material is made to be flush with the corresponding side surface of the dielectric ceramic block. When the conductive paste material is then applied onto the outer surface of the dielectric ceramic block, a layer of the conductive material formed on the side surface of the dielectric ceramic block, and serving as the outer conductor, is connected to the outer end surface of the layer of the conductive material disposed in the concave portion. Thus, the edge portion at which the bottom surface of the concave portion intersects with the side surface of the dielectric ceramic block is covered with a thick layer of the conductive material. Accordingly, the layers at the edge portion will each attain a desired level of strength during a subsequent baking step. Thus, electrode breakage can be prevented which would otherwise occur at the edge portion due to a difference in the thermal expansion coefficients of the dielectric ceramic block and the conductive material.

According to this second aspect of the present invention, there is further provided a dielectric filter having three or more resonators, the filter comprising: a dielectric ceramic block having at least three through-holes formed therein, in parallel, in a group having opposite ends, the at least three through-holes including end through-holes located at opposite ends of the group and at least one intermediate through-hole located between the end through-holes, each of the through-holes having an inner surface and the dielectric ceramic block having an open end surface at which one end of each of the through-holes opens; an inner conductor covering the inner surface of each of the through-holes to respectively form corresponding end resonators and at least one intermediate resonator; an outer conductor covering a predetermined outer surface of the dielectric ceramic block, excluding the open end surface; and input/output pads formed on one side surface of the dielectric ceramic block such that the pads are located near the open end surface and face said end resonators so as to be capacatively coupled thereto, each of the through-holes of the end resonators including a counterbore formed at one end of the corresponding through-hole and opening at the open end surface such that the corresponding through-hole is of increased diameter at said one end; and the filter further comprising an auxiliary conductor disposed on the open end surface so as to face the at least one intermediate resonator, the auxiliary conductor being of a forked shape pattern including at least two branch portions, each of said branch portions being located between adjacent resonators, and the auxiliary conductor at least partially surrounding the at least one intermediate resonator with an insulating gap formed therebetween and being connected to a portion of the outer conductor located on said one side surface on which the input/output pads are formed; and the auxiliary conductor being formed by a conductive material disposed in a concave portion formed in the open end surface in a pattern corresponding to the pattern of the auxiliary conductor.

In this filter construction, as in the case of the dielectric filter according to the first aspect of the invention, the overall length of the dielectric filter can be shortened, and the dielectric filter has a frequency characteristic exhibiting an attenuation peak on the higher-frequency side thereof.

In addition, because the shape of the conductive material is defined by the concave portion, i.e., flow of the conductive material is restricted by the concave portion, the conductive material neither runs nor spreads over the surface of the block. Moreover, since the auxiliary conductor can be formed accurately such that the insulating gap has an intended size and the arcuate edge portion of the auxiliary conductor surrounding the at least one resonator has an intended length, a desired capacitance C can be reliably obtained. Furthermore, since the auxiliary conductor has a thickness corresponding to the depth of the concave portion, the end surface of the auxiliary conductor facing the at least one resonator has a larger area, so that a larger capacitance C can be obtained.

The dielectric filter can be manufactured by the method described above. In this case, the edge portion at which the bottom surface of the concave portion intersects with the corresponding side surface of the dielectric ceramic block is covered with a thick layer of the conductive material. Accordingly, the layers at the edge portion will each attain a desired strength during a subsequent baking step. Thus, electrode breakage can be prevented which would otherwise occur at the edge portion due to a difference in thermal expansion coefficients between the dielectric ceramic block and the conductive material.

Preferably, the auxiliary conductor has an open configuration including an opening which opens toward the side surface opposite to that on which the input/output pads are formed; a second auxiliary conductor extends toward the opening from a portion of the outer conductor located on the opposite side surface, such that the inner edge of the second auxiliary conductor faces the corresponding resonator with an insulating gap formed therebetween; and the second auxiliary conductor is formed by conductive material disposed in a second concave portion formed in the open end surface and having a pattern corresponding to the pattern of the second auxiliary conductor. In this case, an additional capacitance is produced between the second auxiliary conductor and the inner conductor of the corresponding resonator, so that the overall capacitance C is increased. Moreover, the second auxiliary conductor can be accurately formed so that the insulating gap is of an intended size and the second auxiliary conductor is of an intended shape. Furthermore, since the end surface of the second auxiliary conductor facing the corresponding resonator is larger in area, a larger capacitance C can be obtained. In addition, electrode breakage does not occur at the edge portion.

BRIEF DESCRIPTION OF THE DRAWINGS

Various other objects, features and attendant advantages of the present invention will be apparent from the following detailed description of the preferred embodiments, when considered in connection with the accompanying drawings, in which.

DESCRIPTION OF THE PREFERRED EMBODIMENTS

Preferred embodiments of the present invention will now be described with reference to the drawings. Throughout the drawings, identical or corresponding portions are indicated by the same reference symbols for the purpose of simplifying the description.

First, embodiments concerned with the first aspect of the present invention will be described.

A First Embodiment

Figure 1:
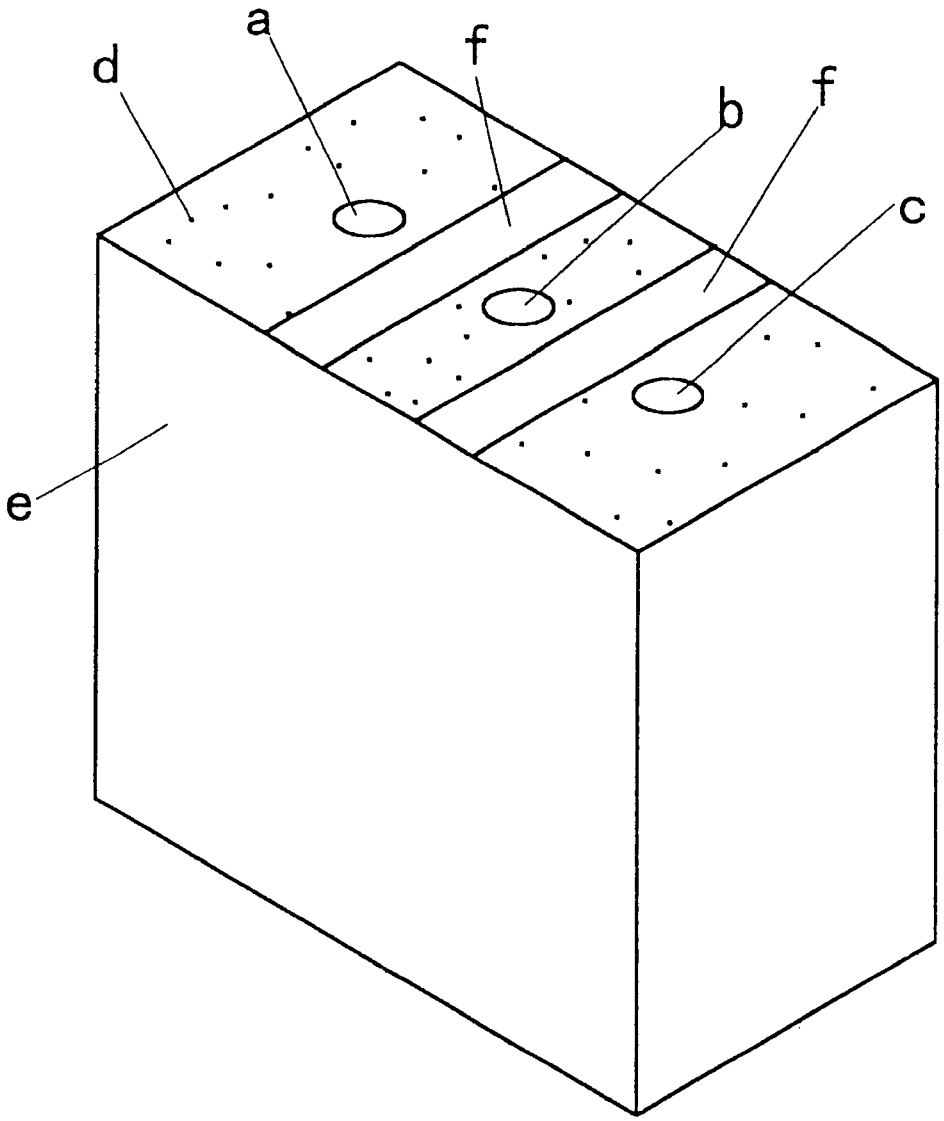
FIG. 1 (PRIOR ART)
FIG. 1 is, as described above, a perspective view of a conventional dielectric filter.
Figure 2:
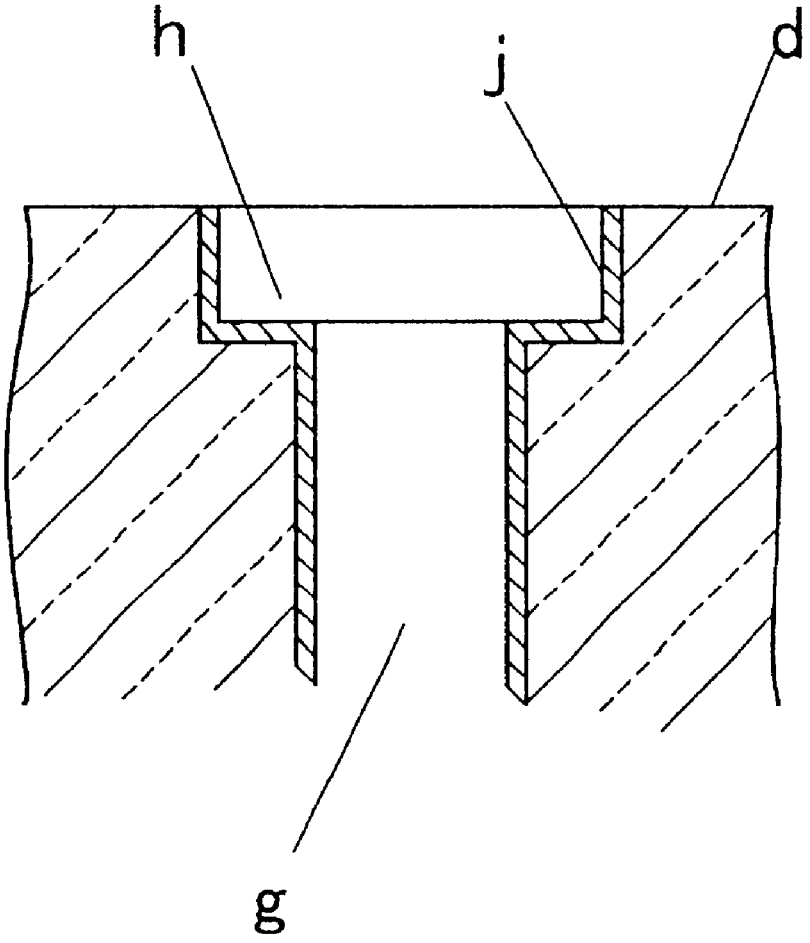
FIG. 2 (PRIOR ART)
FIG. 2 is, as described above, a vertical cross-sectional view taken through a main portion of another conventional dielectric filter.
Figure 3:
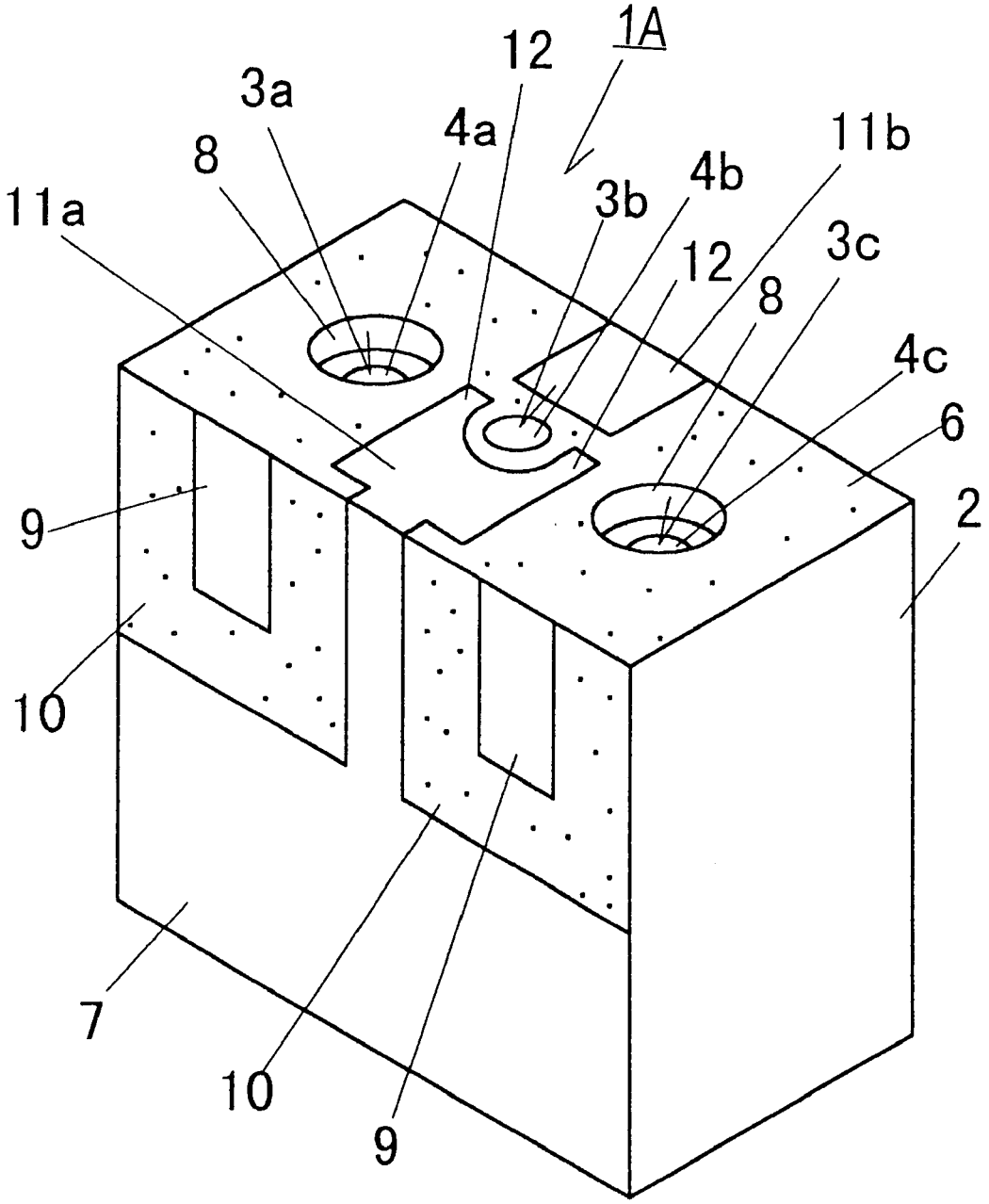
FIG. 3 is a perspective view of a dielectric filter according to a first embodiment of the present invention.
Figure 4:
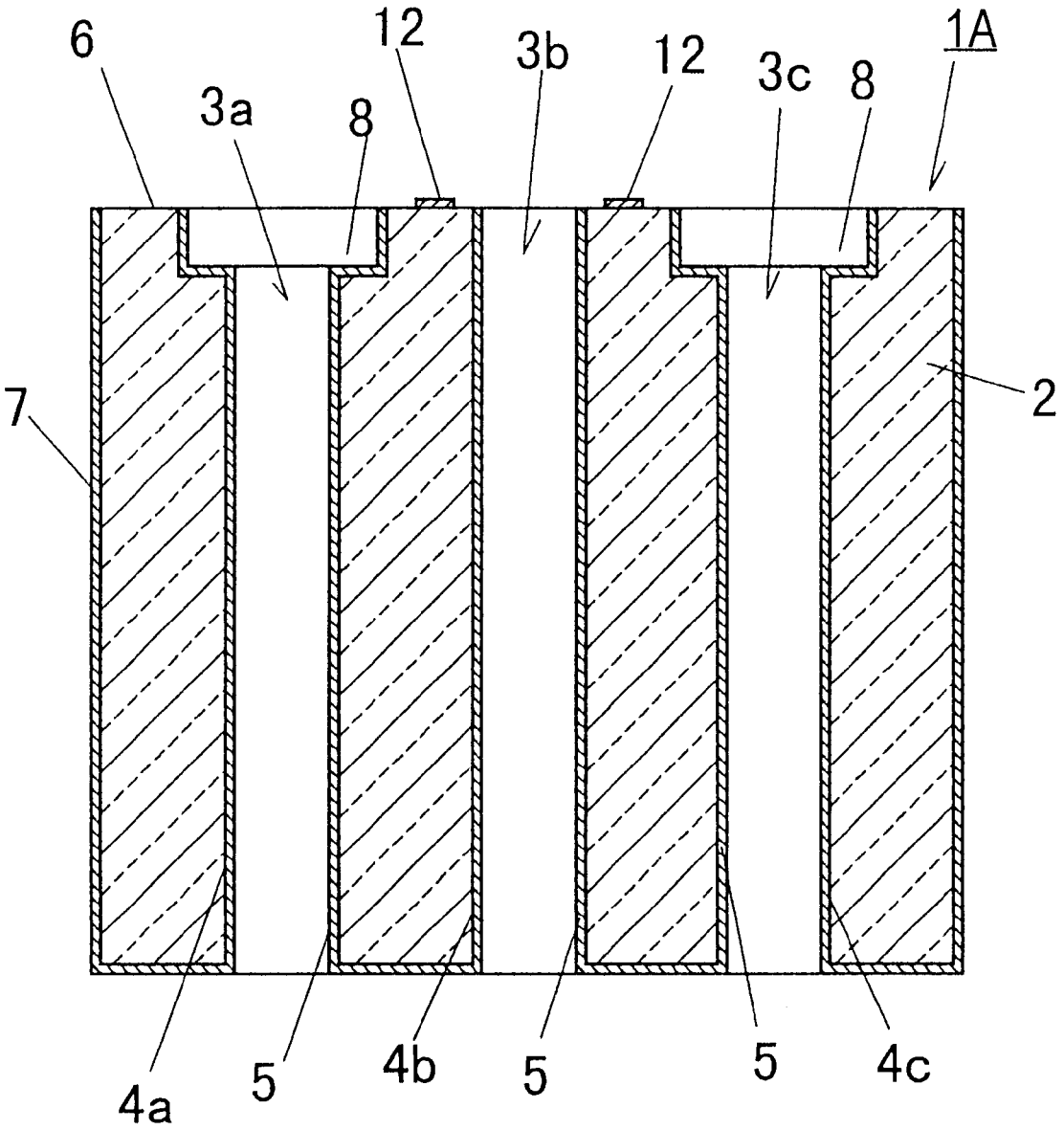
FIG. 4 is a vertical cross-sectional view of the dielectric filter of FIG. 3.
Figure 5:
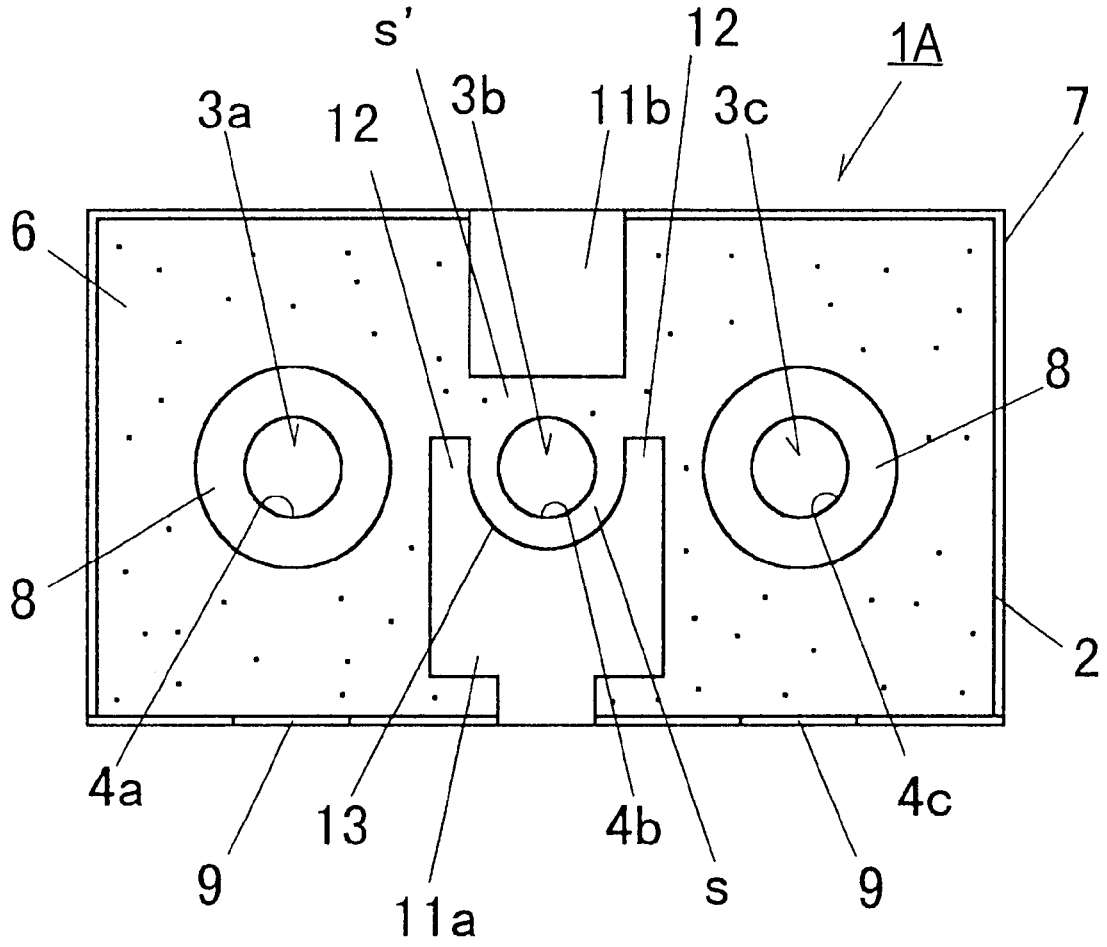
FIG. 5 is a plan view of the dielectric filter of FIG. 3.

FIGS. 3 to 5 show a dielectric filter 1A constructed according to a first embodiment of the present invention. In the dielectric filter 1A, three resonators 3*a*, 3*b*, and 3*c* are formed in parallel in a single dielectric ceramic block 2. The dielectric ceramic block 2 has the shape of a rectangular prism and is made of a dielectric ceramic such as BaO—TiO2 ceramic or BaO—TiO2-(rare earth oxide) ceramic. The resonators 3*a*, 3*b*, and 3*c* are formed in parallel with each other such the resonators are oriented in the same direction. The resonators 3*a*, 3*b*, and 3*c* are formed by coating the inner surfaces of through-holes 4*a*, 4*b*, and 4*c* with conductive material forming inner conductors 5. The outer surface of the dielectric ceramic block 2 is coated with a conductive material forming an outer conductor 7, excluding an open end surface 6 at which the upper ends of the through-holes 4*a*, 4*b*, and 4*c* open. The outer conductor 7 serves as a shield electrode. The left-hand resonator 3*a* and the right-hand resonator 3*c* have counterbores 8 therein which are formed at the upper ends of the through-hole 4*a* and 4*c* that open at the open end surface 6 such that the diameters of the through-holes 4*a* and 4*c* increase at the upper ends. The inner surfaces of the counterbores 8 are also covered with respective inner conductors 5.

Through formation of the counterbores 8 at the upper ends of the through-hole 4*a* and 4*c* that open at the open end surface 6, the inner conductors 5 covering the inner surfaces of the counterbores 8 extend inwardly in the radial direction, so that the inner conductors 5 each extend over an increased distance as compared with the inner conductor of a conventional cylindrical through-hole, and the effective resonance length is increased. Thus, the overall lengths of the resonators 3*a* and 3*c* can be shortened as compared with a conventional dielectric filter which includes simple cylindrical through-holes of the same resonance length, i.e., in which the counterbores 8 are not formed. It is to be noted that the resonance length of the resonators 3*a* and 3*c* is set to a length corresponding to λ4, where λ is the resonance frequency.

As shown in FIG. 3, input/output pads 9 are formed on one side surface of the dielectric ceramic block 2 such that the pads 9 are located near the open end surface 6 and face the left-hand and right-hand resonators 3*a* and 3*c*. The input/output pads 9 are isolated from the outer conductor 7 by means of rectangular portions 10 wherein the conductors are removed. Thus, capacitance coupling is established between the resonator 3*a* and 3*c* and the corresponding input/output pad 9.

A first auxiliary conductor 11*a* and a second auxiliary conductor 11*b* are provided on the upper end surface 6 so as to face the center resonator 3*b*. As is best shown in FIG. 5, the first auxiliary conductor 11*a* is of forked shape and has two branch portions 12, one of which is located between the resonators 3*a* and 3*b*, and the other of which is located between the resonators 3*b* and 3*c*. At the inner edge of the first auxiliary conductor 11*a*, in proximity to the through-hole 4*b*, is formed an arcuate edge portion 13 which is concentric with the through-hole 4*b*. The first auxiliary conductor 11*a* is disposed such that the arcuate edge portion 13 partially surrounds the through-hole 4*b* in spaced relation thereto, i.e., with an insulating gap s being formed therebetween. The outer end of the first auxiliary conductor 11*a* is connected to a portion of the outer conductor 7 located on the side surface on which the input/output pads 9 are provided. The first auxiliary conductor 11*a* has an open configuration such that the arcuate edge portion 13 forms an opening which opens toward the side surface opposite to that on which the input/output pads 9 are formed. The second auxiliary conductor 11*b* extends toward the opening from a portion of the outer conductor 7 located on the opposite side surface to that on which the input/output pads 9 are provided, such that the inner edge of the second auxiliary conductor 11*b* faces the resonator 3*b* and is spaced therefrom, i.e., with an insulating gap s' formed therebetween. The first auxiliary conductor 11*a* and the second auxiliary conductor 11*b* can be formed using a process in which a conductive material in the form of paste is screen-printed on the open end surface 6 in a predetermined pattern.

The resonance frequency of the resonator 3*b*—for which the first auxiliary conductor 11*a* and the second auxiliary conductor 11*b* are provide—is represented by the following equation:

$$1/\omega \cdot C = Z_0 \cdot \tan\beta \cdot L$$

where ω is the angular frequency, $Z_0$ is the characteristic impedance, β is a phase constant, L is the axial length of through-hole 4*b*, and C is the capacitance of the open end surface 6, including capacitances produced by the first auxiliary conductor 11*a* and the second auxiliary conductor 11*b*.

The above equation demonstrates that by providing an increase in the capacitance C of the open end surface 6, the length of the resonator 3*b* can be decreased by an amount corresponding to the increase in the capacitance C, while the resonance frequency is maintained unchanged. Accordingly, the resonance length of the center resonator 3*b* can be made to be the same as those of the left-hand and right-hand resonators 3*a* and 3*c* upon the provision of a suitable capacitance C which is adjusted to a desired value through adjustment of the insulating gaps s and s' and the length of the arcuate edge portion 13 of the first auxiliary conductor 11*a* that surrounds the resonator 3*b*. Thus, the center resonator 3*b* can be shortened so as to have the same length as that of the left-hand and right-hand resonators 3*a* and 3*c*, whereby the overall length of the dielectric filter 1 can be shortened.

Figure 6:
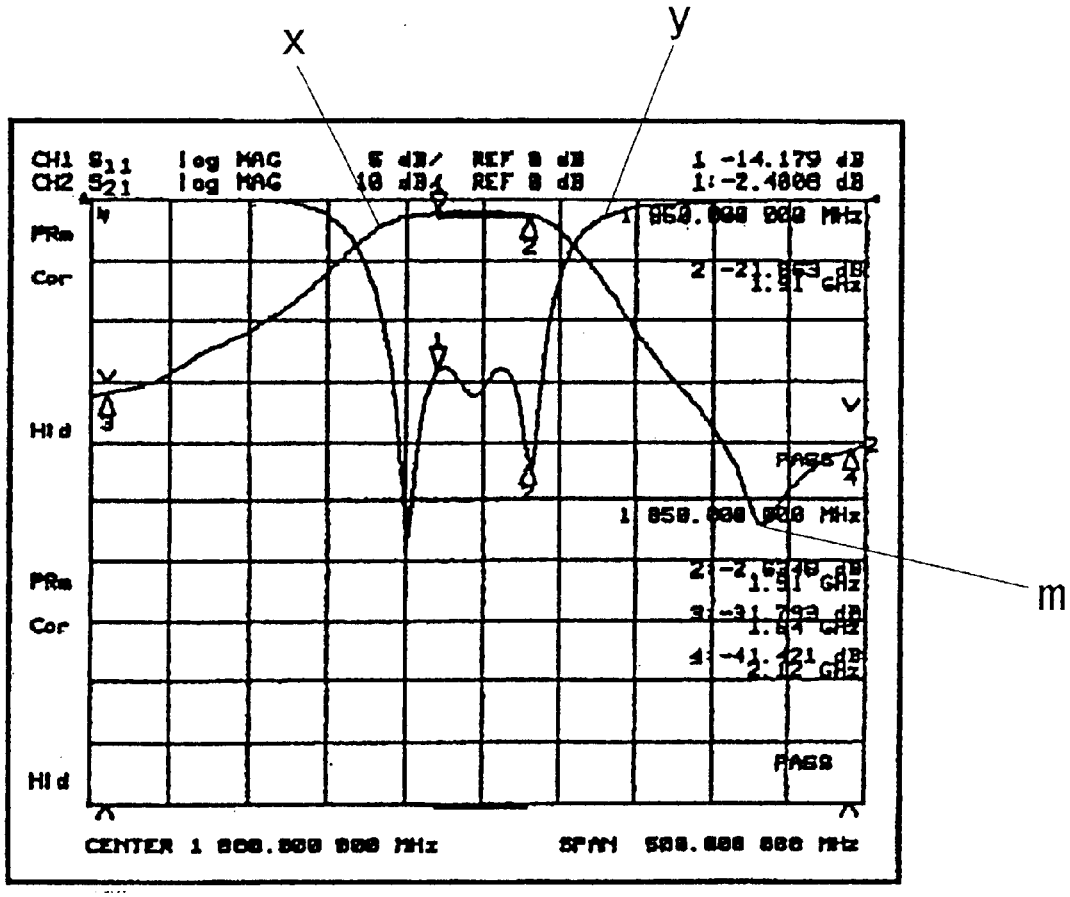
FIG. 6 is a graph showing the filter characteristic of the dielectric filter of FIG. 3.

The dielectric filter 1 has a filter characteristic shown in FIG. 6 in which a frequency characteristic curve x exhibits an attenuation peak m on the higher-frequency side with respect to the center frequency, because the two branch portions 12 of the first auxiliary conductor 11*a* provided on the open end surface 6 are located between the resonators 3*a* and 3*b* and between the resonators 3*b* and 3*c*, respectively, and the outer end of the first auxiliary conductor 11*a* is connected to a portion of the outer conductor 7 located on the side surface on which the input/output pads 9 are provided. Therefore, the dielectric filter 1 can be designed to have a peak on the higher-frequency side through provision of the branch portions 12. FIG. 6 also shows a curve y indicating the simultaneously measured reflection wave characteristic.

The second auxiliary conductor 11*b* is provided on the open end surface 6 only for the purpose of increasing the capacitance C. Therefore, when the desired capacitance C is obtained by provision of only the first auxiliary conductor 11*a*, the provision of the second auxiliary conductor 11*b* is unnecessary, i.e., conductor 11*b* can be omitted. Further, the first auxiliary conductor 11*a* can be formed to have an annular edge portion which surrounds the entire circumference of the through-hole 4*b* of the resonator 3*b*, i.e., which completely surrounds, rather than partially surrounds, through-hole 4*b*.

A Second Embodiment

Figure 7:
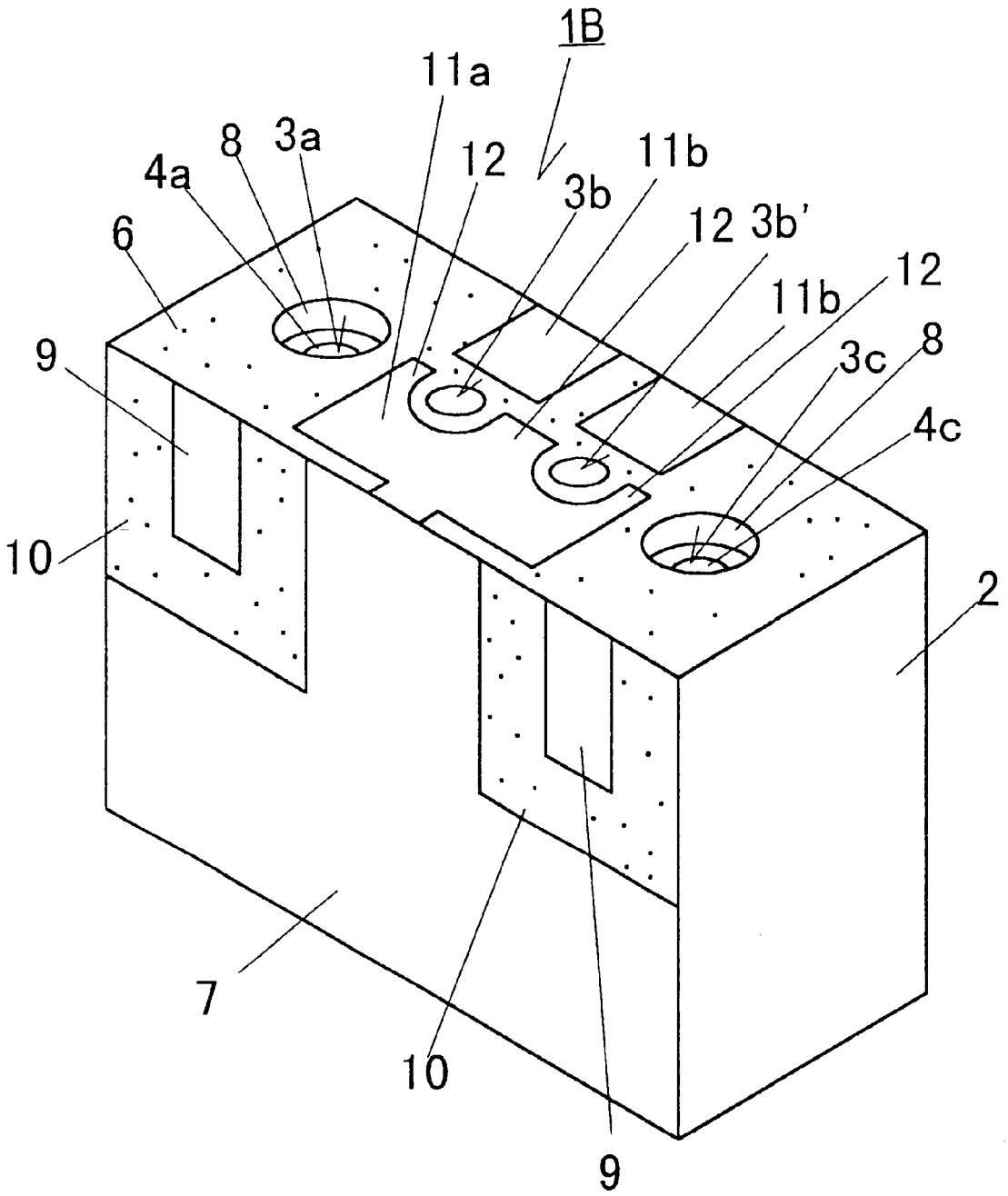
FIG. 7 is a perspective view of a dielectric filter according to a second embodiment of the present invention.

In the above-described first embodiment, a three-stage dielectric filter composed of three resonators 3*a*, 3*b*, and 3*c* is provided. However, it is to be understood that the present invention can also be applied to a multi-stage dielectric filter having four or more stages. FIG. 7 shows a four-stage dielectric filter 1B according to a second embodiment of the present invention. In the dielectric filter 1B, four resonators 3*a*, 3*b*, 3*b*', and 3*c* are formed in parallel in a single dielectric ceramic block 2. The left-hand resonator 3*a* and the right-hand resonator 3*c* have counterbores 8 which are formed at the upper ends of the through-hole 4*a* and 4*c* and which open at the open end surface 6 such that the diameters of the through-holes 4*a* and 4*c* increase at the upper ends thereof. Further, a first auxiliary conductor 11*a* is provided on the upper end surface 6 so as to face the center resonators 3*b* and 3*b*', respectively. The first auxiliary conductor 11*a* is of forked shape and has three branch portions 12. The first branch portion is located between the resonators 3*a* and 3*b*, the second branch portion is located between the resonators 3*b* and 3*b*', and the third branch portion is located between the resonators 3*b*' and 3*c*. The outer end of the first auxiliary conductor 11*a* is connected to a portion of the outer conductor 7 located on the side surface on which the input/output pads 9 are provided. If necessary, auxiliary conductors 11*b* are provided and, as illustrated, the second auxiliary conductors 11*b* extend from the outer conductor 7 on the side surface opposite to that on which the input/output pads 9 are provided.

As described above, even in a multi-stage dielectric filter having four or more stages, the counterbores 8 of the left-hand and right-hand resonators 3*a* and 3*c* increase the effective resonance lengths of the resonators 3*a* and 3*c*, so that the lengths of the resonators 3*a* and 3*c* can be reduced. On the other hand, the lengths of the center-side resonators 3*b* and 3*b*' can be reduced by the presence of the capacitance C of the open end surface 6 provided by the first auxiliary conductor 11*a* alone or in cooperation with the auxiliary conductors 11*b*. Therefore, the overall length of the dielectric filter 1B can be decreased. In addition, because of the presence of the branch portions 12 of the first auxiliary conductor 11*a*, the frequency characteristic of the dielectric filter 1B exhibits a peak in the higher-frequency side thereof with respect to the center frequency.

A Third Embodiment

Figure 8:
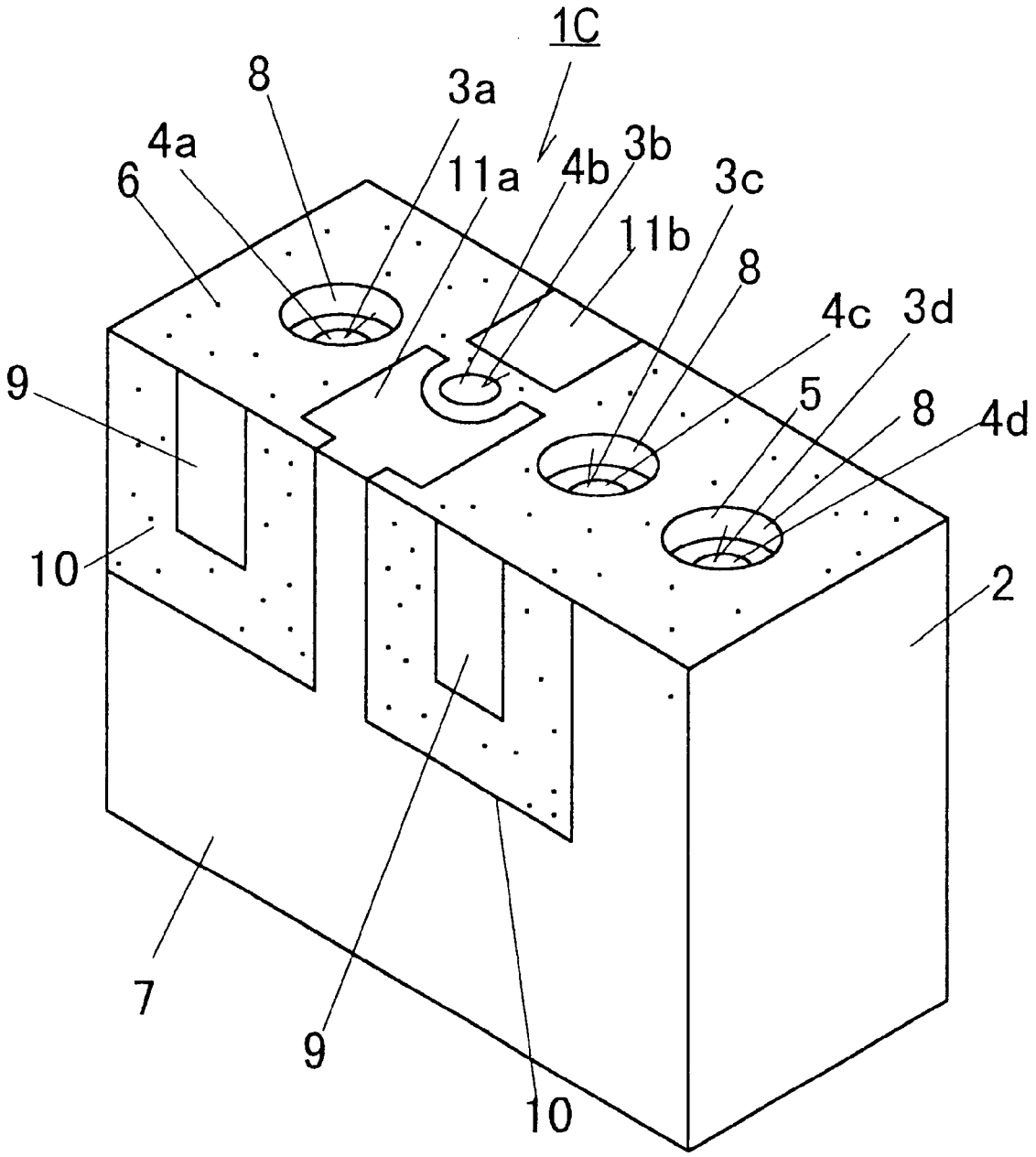
FIG. 8 is a perspective view of a dielectric filter according to a third embodiment of the present invention.

FIG. 8 shows a dielectric filter 1C according to a third embodiment of the present invention. In the dielectric filter 1C, a group of four resonators 3*a*, 3*b*, 3*c*, and 3*d* are formed in parallel in a single dielectric ceramic block 2. Three adjacent resonators 3*a*, 3*b*, and 3*c* (the three left-hand resonators as viewed in FIG. 8) constitute a three-stage dielectric filter, and the resonator 3*d* located at the right end of the group serves as a trap resonator. The three-stage dielectric filter is completed through formation of the input/output pads 9 on one side surface of the dielectric ceramic block 2 such that the pads 9 are located near the open end surface 6 and face the left-hand and right-hand resonators 3*a* and 3*c*. The resonators 3*a*, 3*b*, and 3*c* have the same structure as those of the resonators 3*a*, 3*b*, and 3*c* of the first embodiment. Therefore, similar portions are given the same reference numerals, and further description thereof is omitted as being redundant. The resonator 3*d* serving as a trap resonator has the same structure as those of the resonators 3*a* and 3*c*. In particular, the inner surface of the through-hole 4*d* formed in the dielectric ceramic block 2 is covered with an inner conductor 5, and a counterbore 8 is formed at the upper end of the through-hole 4*d* which opens at the open end surface 6 such that the through-hole 4*d* is of increased diameter at the upper end thereof. Thus, the length of the resonator 3*d* is shortened as well.

As described above, the resonator 3*d* serving as a trap resonator is disposed at the end of the dielectric ceramic block 2 such that inter-stage coupling is established between the resonator 3*b* and the resonator 3*c* of the preceding stage. Therefore, a trap effect is produced at a self-resonance frequency outside the pass band, whereby spurious signals can be attenuated to provide elimination thereof.

In the present embodiment, the resonator 3*d* serving as a trap resonator is disposed at the end of the dielectric ceramic block 2 so as to be located adjacent to the resonator 3*c*, which is an output-side resonator. However, it will be understood that the resonator 3*d* serving as a trap resonator may be disposed at the opposite end of the dielectric ceramic block 2 to be located adjacent to the resonator 3*a*, which is an input-side resonator.

Next, embodiments in relation to the second aspect of the present invention will be described.

A Fourth Embodiment

Figure 9:
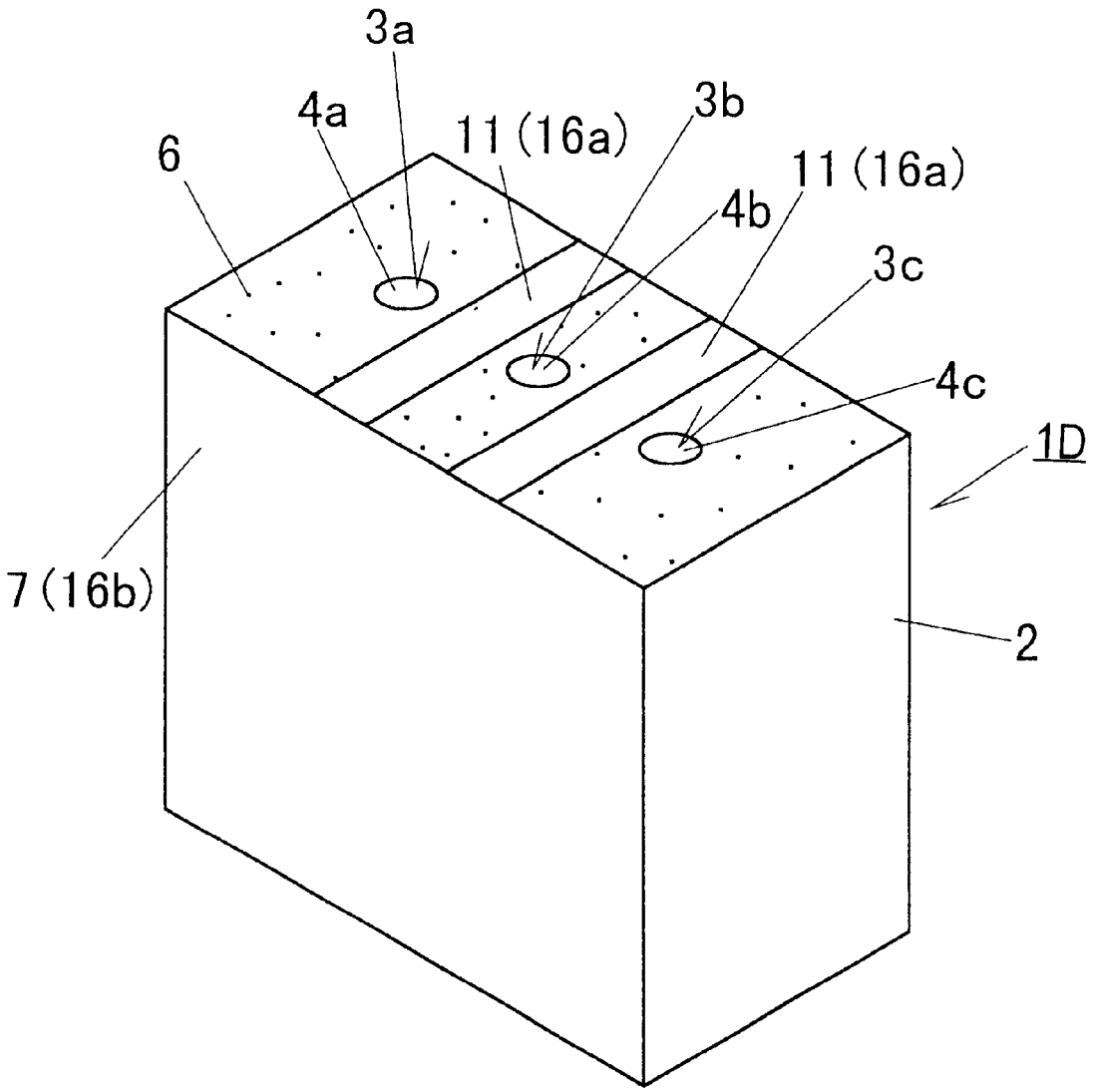
FIG. 9 is a perspective view of a dielectric filter according to a fourth embodiment of the present invention.
Figure 10:
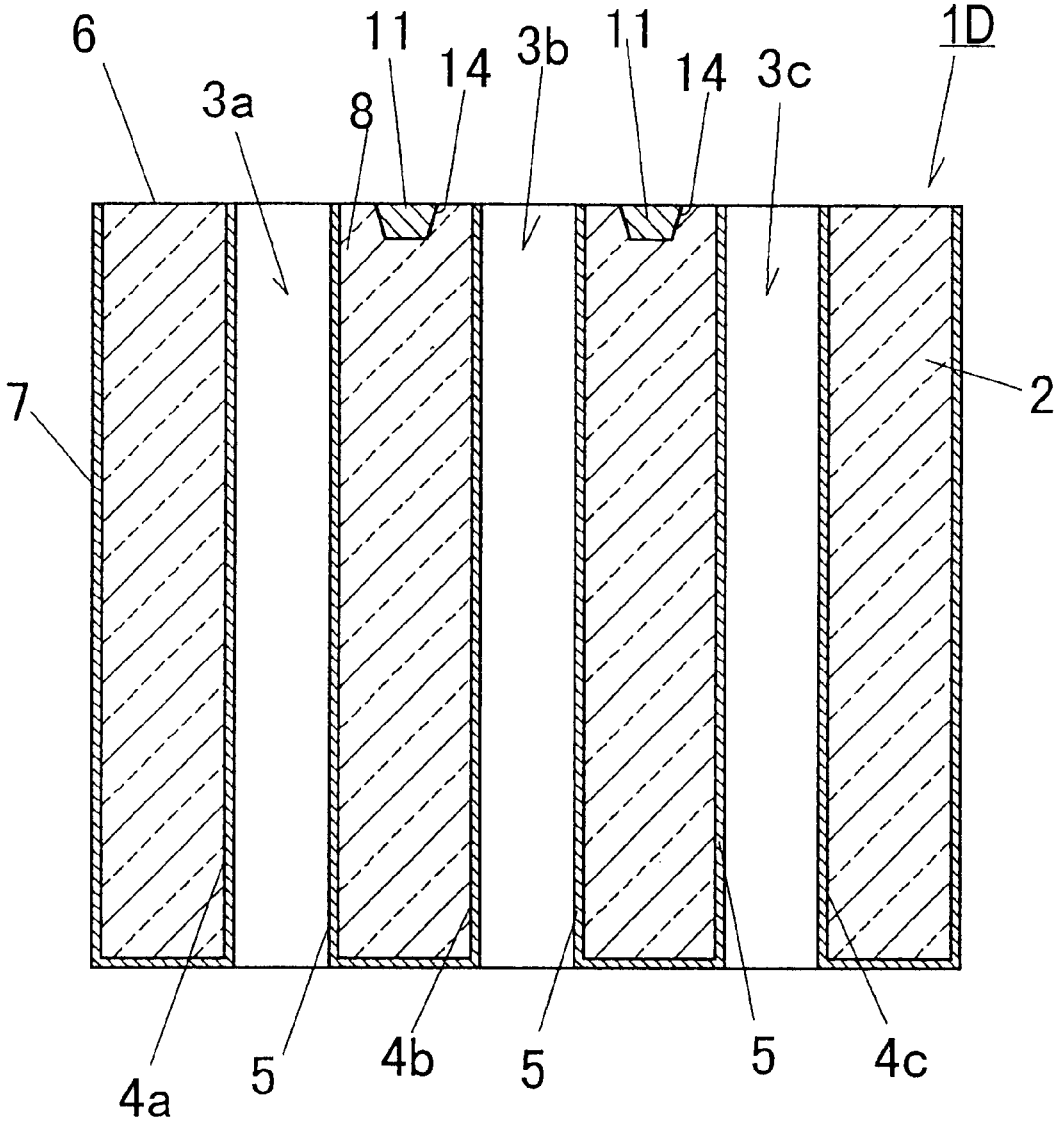
FIG. 10 is a vertical cross-sectional view of the dielectric filter of FIG. 9.

FIGS. 9 and 10 show a dielectric filter 1D according to a fourth embodiment of the present invention. In the dielectric filter 1D, three resonators 3*a*, 3*b*, and 3*c* are formed in parallel in a single dielectric ceramic block 2 to thereby form a three-stage dielectric filter. The dielectric ceramic block 2 has the shape of a rectangular prism and is made of a dielectric ceramic such as BaO—TiO2 ceramic or BaO—

TiO2—(rare earth oxide) ceramic. The resonators 3*a*, 3*b*, and 3*c* are formed in parallel to each other such that the resonators are oriented in the same direction. The resonators 3*a*, 3*b*, and 3*c* are formed by coating the inner surfaces of through-holes 4*a*, 4*b*, and 4*c* with respective inner conductors 5. The outer surface of the dielectric ceramic block 2 is coated with an outer conductor 7, except for an open end surface 6 at which upper ends of the through-holes 4*a*, 4*b*, and 4*c* open. The outer conductor 7 serves as a shield electrode. Two strip-shaped auxiliary conductors 11 are provided on the open end surface 6 such that one auxiliary conductor 11 crosses the space between the resonators 3*a* and 3*b*, i.e., extends between opposite sides of block 2 in spaced relation to resonators 3*a* and 3*b*, and the other auxiliary conductor 11 crosses the space between the resonators 3*b* and 3*c*. The opposite ends of each auxiliary conductor 11 are connected to the outer conductors 7 provided on the respective outer side surfaces. Each auxiliary conductor 11 is formed using a process in which concave portions or recesses 14 (see FIG. 11) are formed on the open end surface 6 of block 2 in the pattern to be assumed by the auxiliary conductors 11, i.e., as two parallel recessed between the respective resonators, and a conductive material is then used to fill the concave portions 14.

Figure 11:
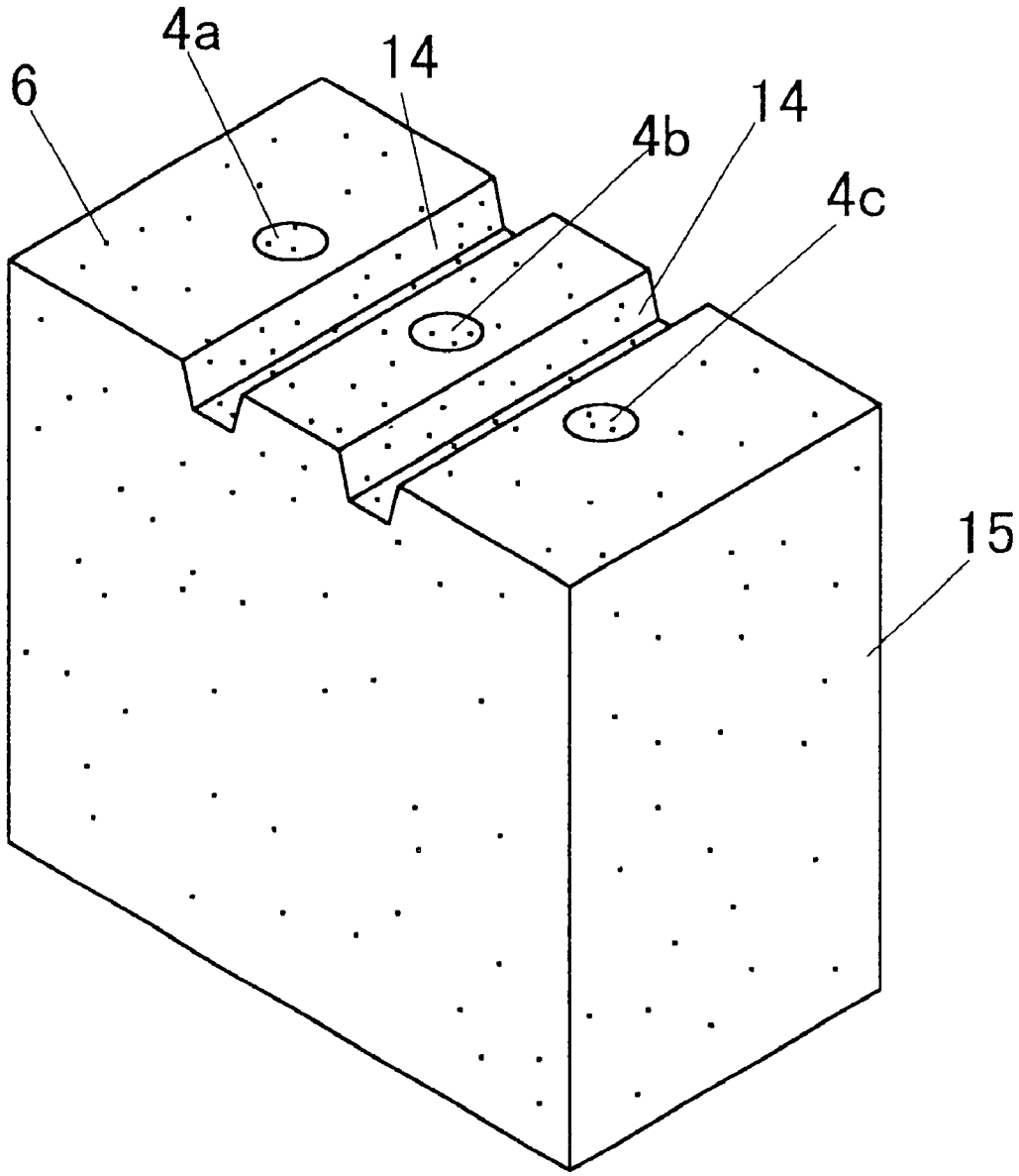
FIG. 11 is a perspective view of a green body obtained through press-forming of ceramic powder and used for production of the dielectric filter of FIG. 9.

Next will be described a method of manufacturing the dielectric filter 1D. First, powder of dielectric ceramic, such as BaO—TiO2 ceramic or BaO—TiO2—(rare earth oxide) ceramic, is fed into a mold, and is press-formed under a pressure of about 1000 kg/cm$^2$ to thereby produce a green body having the shape of a substantially rectangular prism. The mold used for press forming has on the inner surface thereof convex portions corresponding to the concave portions 14. Thus, as shown in FIG. 11, the concave portions or recesses 14 of predetermined shape are formed on one end surface of the green body 15. This surface serves as the open end surface 6, and the opposite outer ends of each concave portion or recess 14 open at the respective side surfaces of the green body 15. Further, the through-holes 4*a*, 4*b*, and 4*c* are simultaneously formed in the green body 15 by means of shaft-shaped cores or cylindrical elements disposed within the mold. Subsequently, the green body 15 is sintered at a temperature of about 1200 to 1300 C, to produce the dielectric ceramic block 2.

Figure 12A:
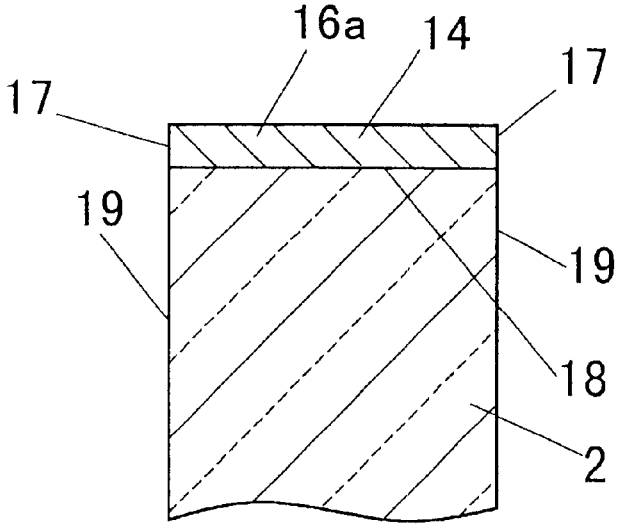
FIGS. 12A and 12B are side elevational views showing steps in the process of applying a conductive material onto the green body of FIG. 11.
Figure 12B:
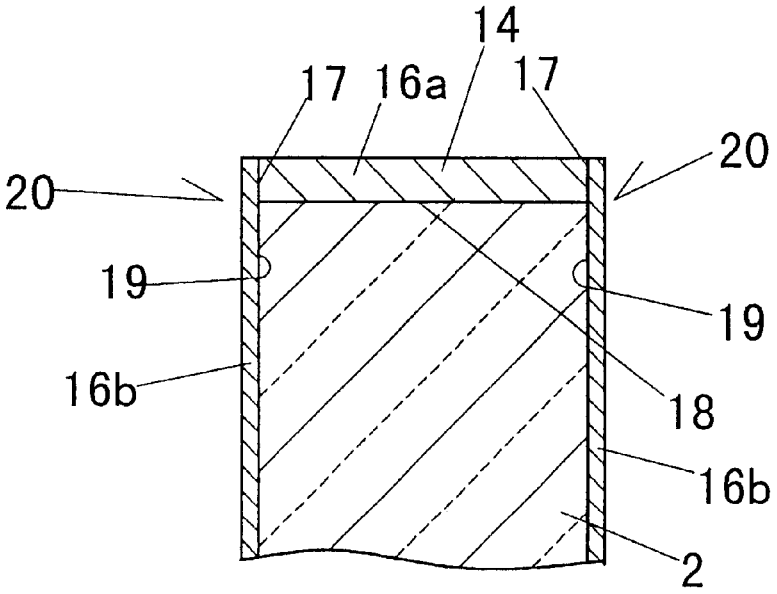

Subsequently, as shown in FIG. 12A, a conductive material 16*a*, such as silver, in the form of paste is charged into the concave portions 14 to a thickness corresponding to the depth of the concave portions 14, i.e., so as to fill the concave portions to the level of the end surface. The charging of the conductive material 16*a* can be performed using screen printing or any other appropriate process. As a result of the charging of the conductive material 16*a* into the concave portions 14 to a thickness corresponding to the depth of the concave portions 14, a layer of the conductive material 16*a* is formed in each concave portion 14 such that the opposite ends 17 of the layer are flush with the respective side surfaces of the dielectric ceramic block 2. Subsequently, a conductive material 16*b* in the form of paste is applied onto the outer surface of the dielectric ceramic block 2, except for the open end surface 6, by means of screen printing. As a result, as shown in FIG. 12B, a layer of the conductive material 16*b* is formed on each side surface of the dielectric ceramic block 2 and is connected to the corresponding end surface 17 of the layer of the conductive material 16*a* filling each concave portion 14. Thus, each edge portion 20, at which a bottom surface 18 of each concave portion 14 and the corresponding side surface of the dielectric ceramic block 2 intersect with each other, is covered with thick layers. As a consequence, the thicknesses of the layers of the conductive materials 16*a* and 16*b* will not and do not decrease at the edge portions due to surface tensions of the conductive materials 16*a* and 16*b* as in prior art filters. Therefore, a desired layer thickness can be obtained. In addition, a conductive material in the form of paste—which is to serve as the inner conductor 5—is applied onto the inner surface of the through-holes 4*a*, 4*b*, and 4*c* by means of vacuum suction or the like.

Subsequently, the dielectric ceramic block 2 carrying the conductive materials is baked at a predetermined temperature. In the end product, as shown in FIG. 9, the conductive material 16*b* forms the outer conductor 7 on the outer surface of the dielectric ceramic block 2, and the conductive material 16*a* forms the auxiliary conductors 11 within the concave portions 14 of the open end surface 6 such that the opposite ends of the auxiliary conductors 11 are in electrical communication with, i.e., are electrically connected to, portions of the outer conductor 7 located on the opposite side surfaces of the dielectric ceramic block 2. As a result of the above-described steps, the dielectric filter 1D shown in FIG. 9 is produced.

In the dielectric filter of the present embodiment, as described above, the conductive material 16*a* in the form of paste is charged into the concave portions 14—which are, of course, of the same pattern as that of the auxiliary conductors 11 and are formed on the open end surface 6—to a thickness corresponding to the depth of the concave portions 14, such that the ends 17 of the layer of the conductive material 16*a* are flush with the respective side surfaces of the dielectric ceramic block 2, and a conductive material 16*b* in the form of paste is applied onto the outer surface of the dielectric ceramic block 2, such that a layer of the conductive material 16*b* formed on each side surface of the dielectric ceramic block 2 is connected to the corresponding end surface 17 of the layer of the conductive material 16*a*. Thus, each edge portion 20, at which the bottom surface 18 of each concave portion 14 intersects with the corresponding side surface 19 of the dielectric ceramic block 2, is covered with the layers of the conductive materials 16*a* and 16*b* each of a desired thickness. Accordingly, the layers at the edge portion 20 will each attain a desired level of strength during the subsequent baking step. Thus, electrode breakage is prevented which would otherwise occur at the edge portion 20 due to differences in the thermal expansion coefficients of the dielectric ceramic block 2 and the conductive materials 16*a* and 16*b*.

As described above, in the formation of the auxiliary conductors 11, the conductive material 16*a* in the form of paste is charged into the concave portions 14 formed on the open end surface 6. Since the shape of the conductive material 16*a* is defined by the concave portions 14, i.e., flow of the conductive material 16*a* is restricted by the concave portions 14, the conductive material 16*a* neither runs nor spreads. Thus, auxiliary conductors 11 of a desired pattern determined by the concave portions 14 can be accurately formed.

Although not shown in FIGS. 9 and 10, input/output pads, which are coupled to the resonators 3*a* and 3*c* by means of capacitance coupling, may be formed during application of the conductive material 16*b*. Specifically, the conductive material 16*b* is screen printed in a predetermined pattern on one side surface of the dielectric ceramic block 2 such that the input/output pads are formed on the side surface while being isolated from the outer conductor 7. In the present embodiment, a three-stage dielectric filter composed of three resonators 3*a*, 3*b*, and 3*c* is described. However, it will be understood that the basic structural feature of the embodiment described above, i.e., the provision of the strip-shaped auxiliary conductors 11—which enables the dielectric filter to exhibit a peak in the frequency characteristic thereof on the higher-frequency side—can be applied to a two-stage dielectric filter or a multi-stage dielectric filter having four or more stages.

A Fifth Embodiment

Figure 13:
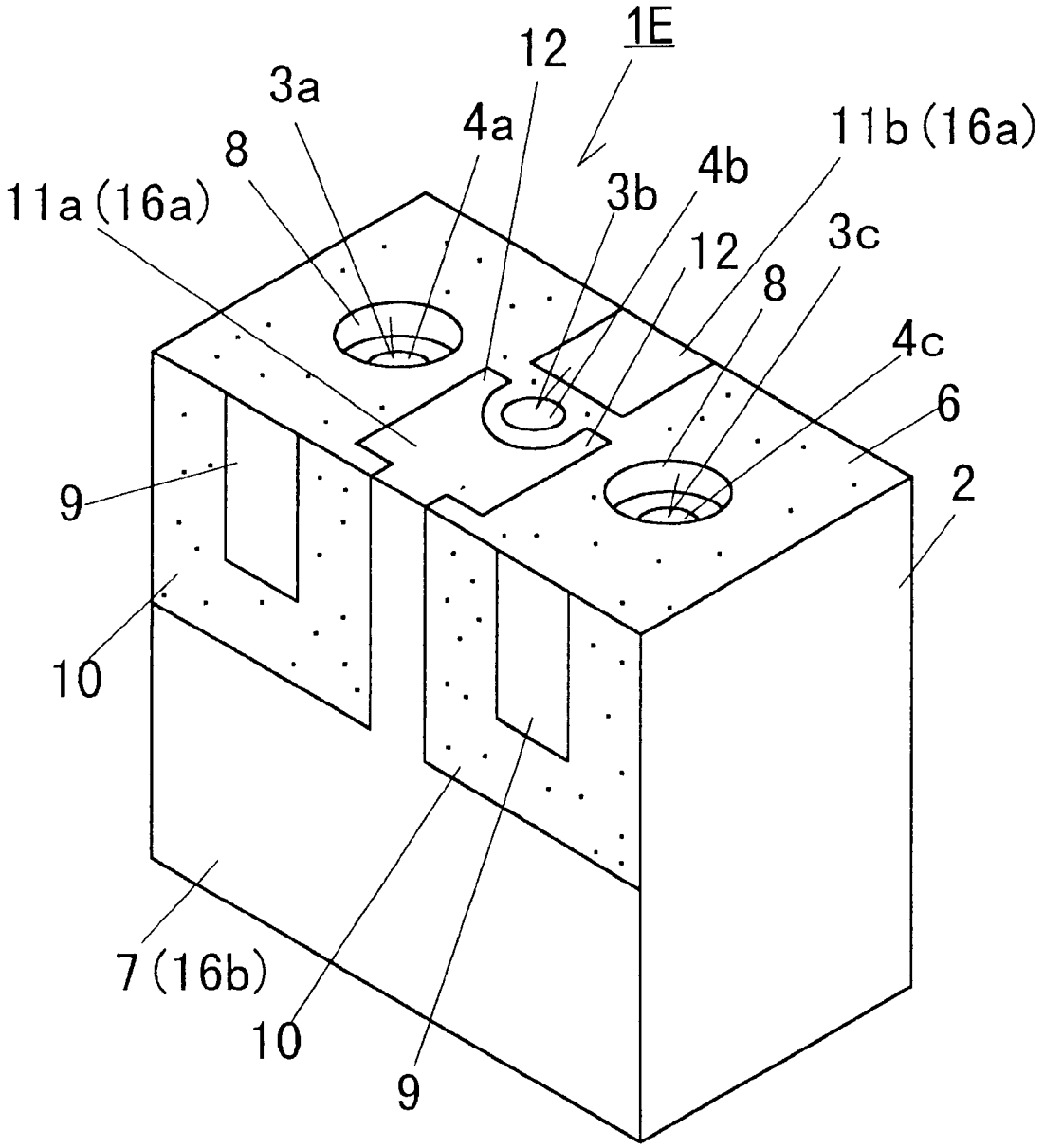
FIG. 13 is a perspective view of a dielectric filter according to a fifth embodiment of the present invention.
Figure 14:
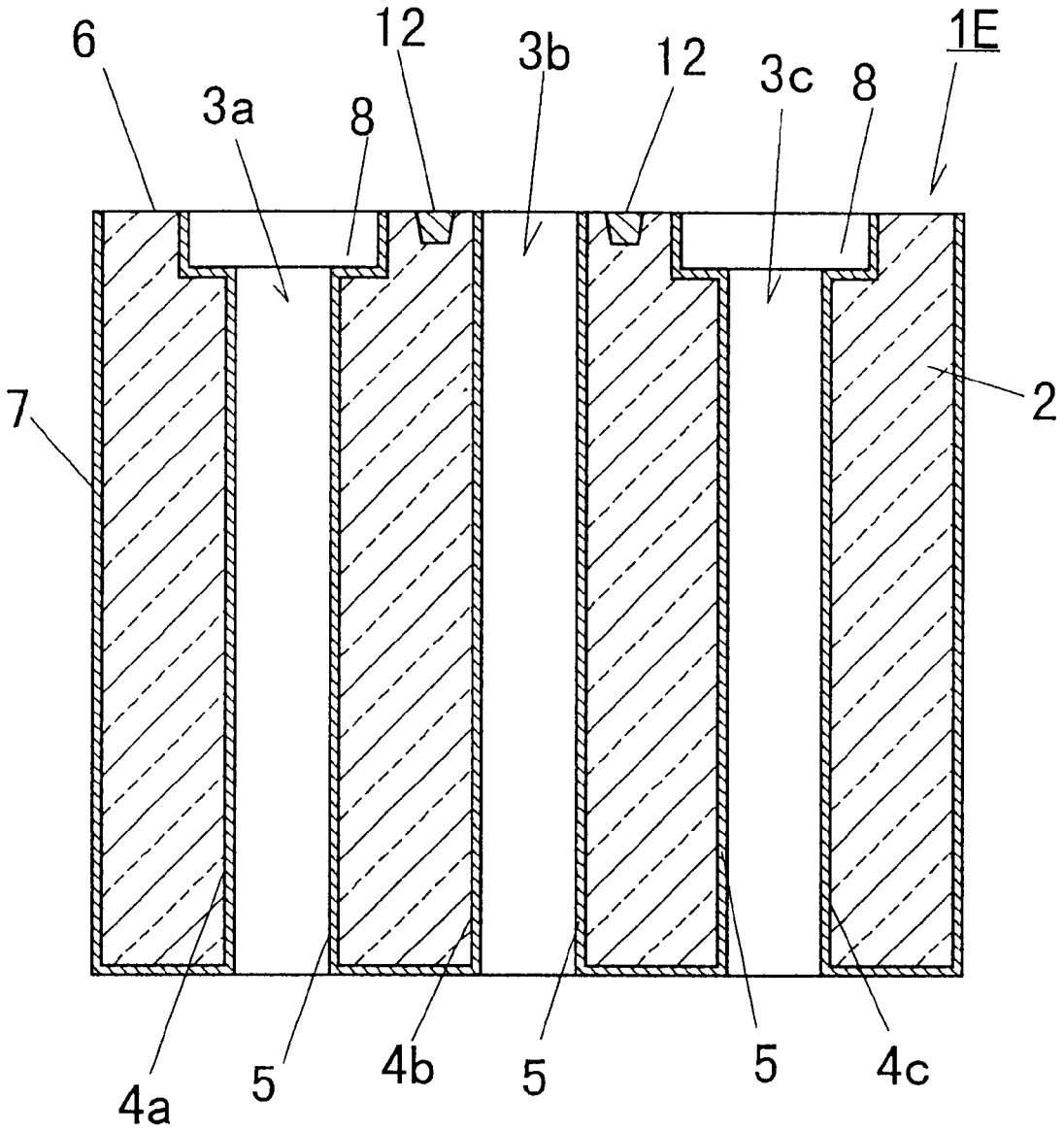
FIG. 14 is a vertical cross-sectional view of the dielectric filter of FIG. 13.
Figure 15:
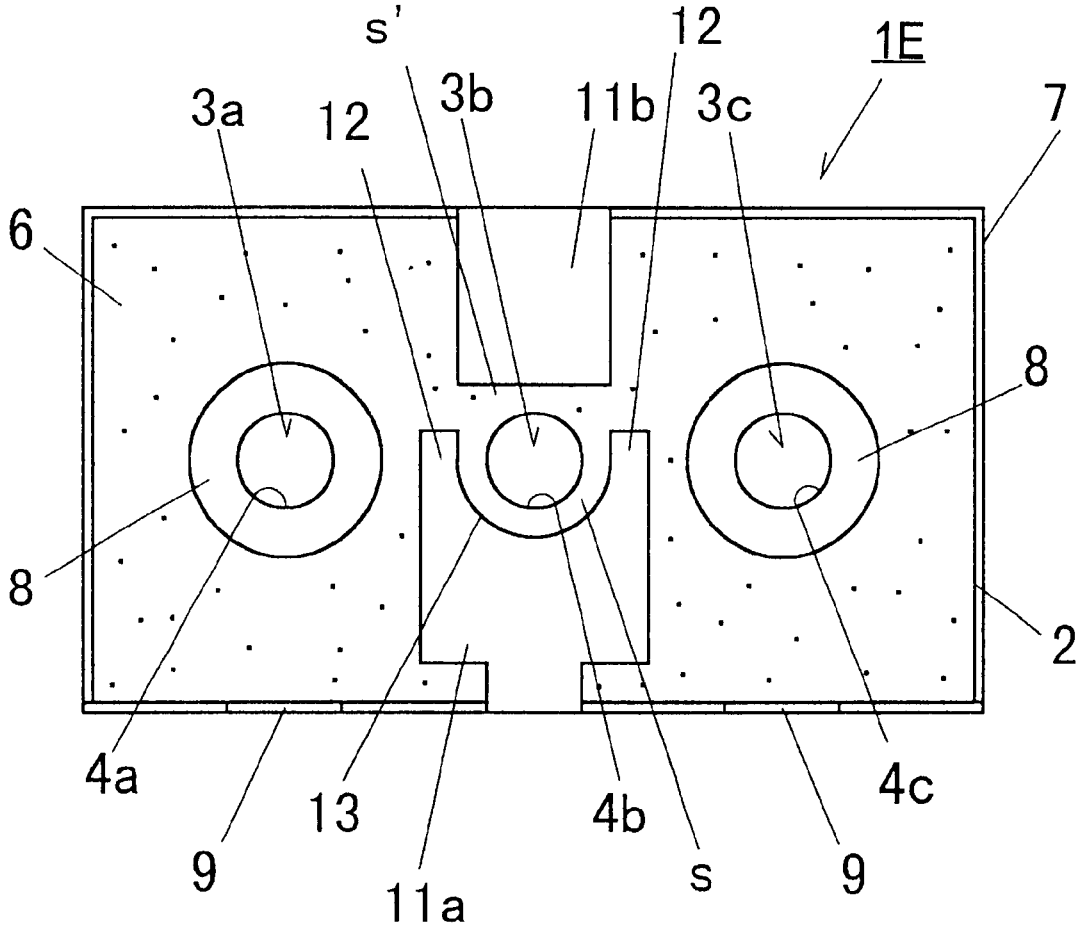
FIG. 15 is a plan view of the dielectric filter of FIG. 13.

FIGS. 13 to 15 show a dielectric filter 1E according to a fifth embodiment of the present invention. Because the dielectric filter 1E is of a structure similar to that of the first embodiment, the structure of the dielectric filter 1E will not be described again. The dielectric filter 1E is produced in the same manner as in the first embodiment, except for the step of forming the first auxiliary conductor 11*a* and the second auxiliary conductor 11*b*. Instead, the auxiliary conductors 11*a* and 11*b* are formed using a process in which concave portions 14*a* and 14*b* of a pattern corresponding to the pattern of the auxiliary conductors 11*a* and 11*b* are formed on the open end surface 6 (see FIG. 16), and a conductive material is charged into, i.e., is used to fill, the concave portions 14*a* and 14*b*.

Figure 16:
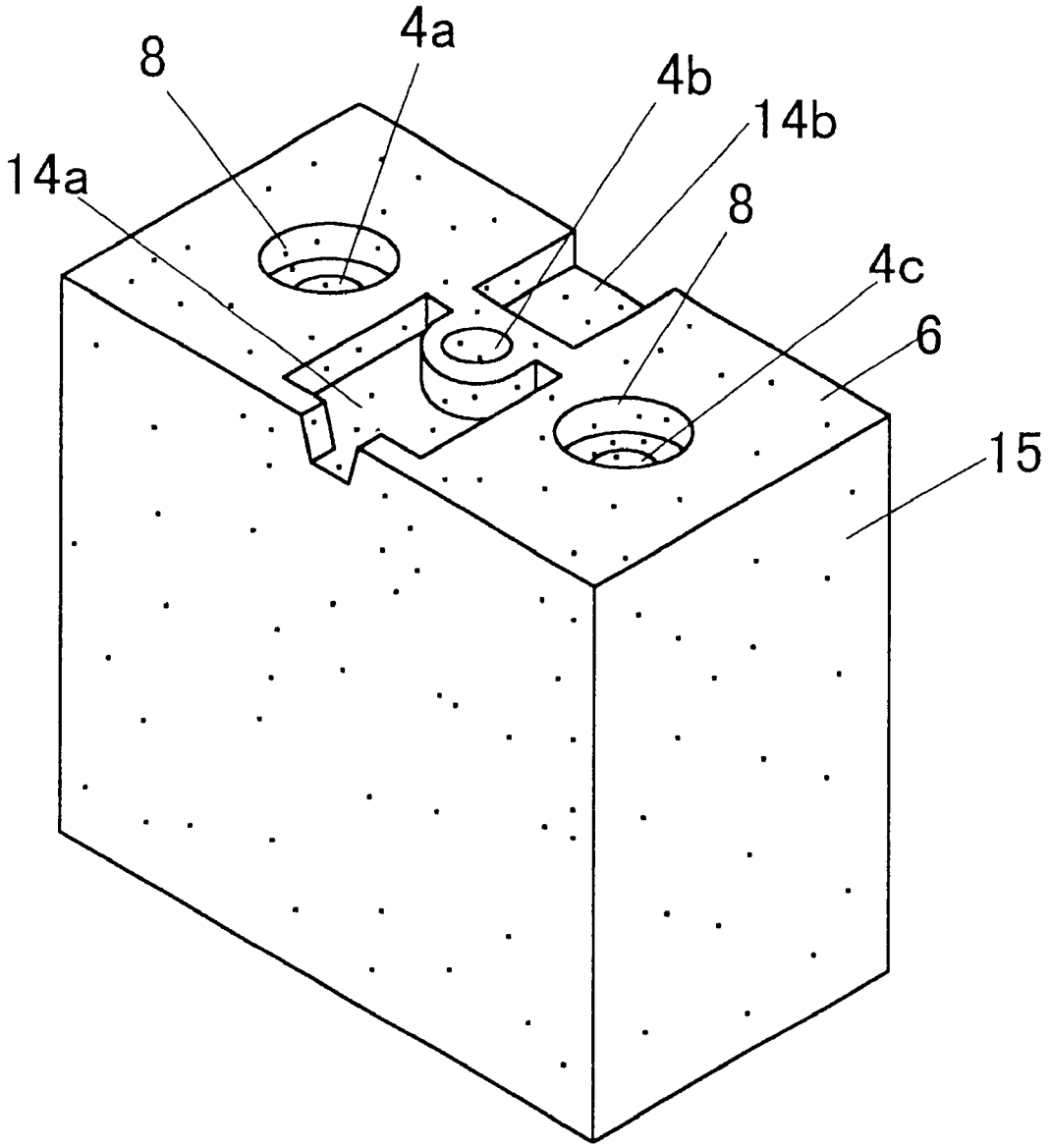
FIG. 16 is a perspective view of a green body obtained through press-forming of ceramic powder and used in the production of the dielectric filter of FIG. 13.

A preferred method of manufacturing the dielectric filter 1E will now be described. First, powder of dielectric ceramic is press-formed so as to obtain a green body having the shape of a substantially rectangular prism, using a mold which has on the inner surface thereof convex portions corresponding to the concave portions 14*a* and 14*b*. Thus, as shown in FIG. 16, the concave portions 14*a* and 14*b* of a predetermined shape are formed on one end surface of the green body 15. This surface is to serve as the open end surface 6, and the outer ends of the concave portions 14*a* and 14*b* open at the corresponding side surfaces of the green body 15. Further, the through-holes 4*a*, 4*b*, and 4*c* are simultaneously formed in the green body 15 by means of shaft-shaped cores or cylindrical elements disposed within the mold. Simultaneously, counterbores 8 are formed at the upper ends of the through-holes 4*a* and 4*c* by means of projections disposed within the mold and having a shape corresponding to that of the counterbores 8.

Figure 17A:
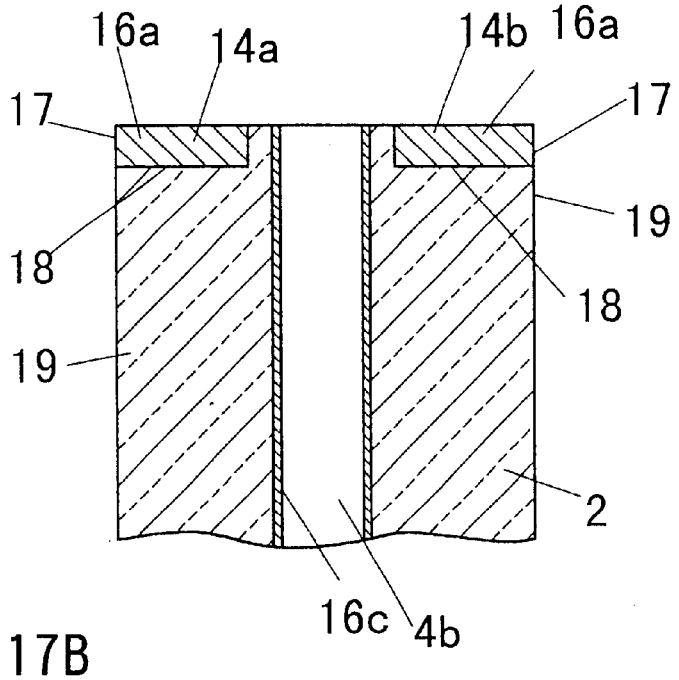
FIGS. 17A and 17B are side elevational views showing steps in the process of applying a conductive material onto the green body of FIG. 13.
Figure 17B:
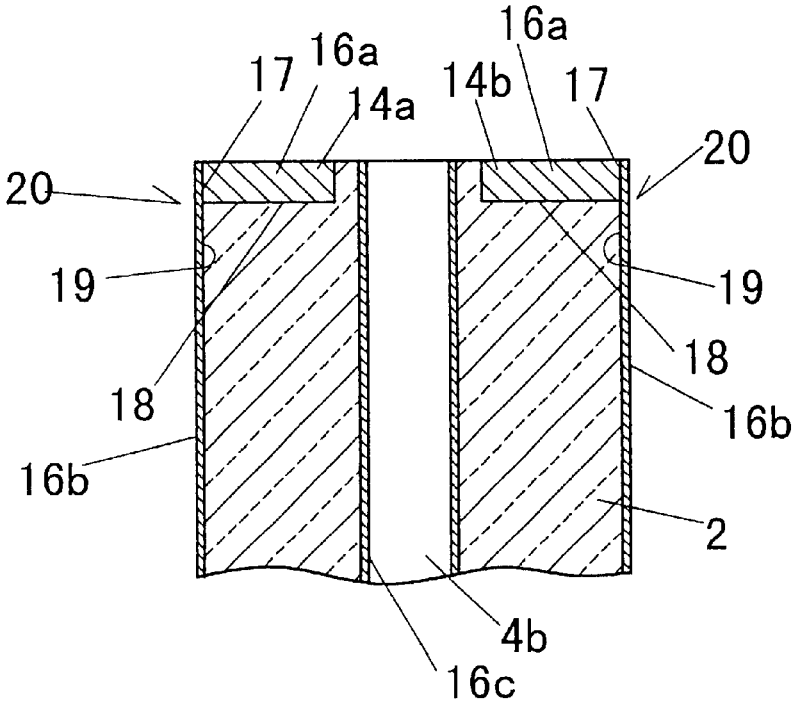

After the green body 15 is sintered to thereby produce the dielectric ceramic block 2, as shown in FIG. 17A, a conductive material 16*a*, such as silver, in the form of paste is charged into the concave portions 14*a* and 14*b* to a thickness corresponding to the depth of the concave portions 14*a* and 14*b*. The charging of the conductive material 16*a* can be performed using screen printing or any other appropriate process. As a result of the charging of the conductive material 16*a* into the concave portions 14*a* and 14*b* to a thickness corresponding to the depth of the concave portions 14*a* and 14*b*, a layer of the conductive material 16*a* is formed in each of the concave portions 14*a* and 14*b* such that the outer end 17 of each layer lies flush with the corresponding side surface 19 of the dielectric ceramic block 2. Subsequently, a conductive material 16*b* in the form of paste is applied onto the outer surface of the dielectric ceramic block 2, except for the open end surface 6, by means of screen printing. During this step, input/output pads 9 are printed in a predetermined pattern on the side surface 19 of the dielectric ceramic block 2 at which the outer end of the concave portion 14*a* opens. As a result of application of the conductive material 16*b* to the outer surface of the dielectric ceramic block 2, as shown in FIG. 17B, a layer of the conductive material 16*b* is formed on each side surface 19 of the dielectric ceramic block 2 which is connected to the corresponding outer end surface 17 of the layer of the conductive material 16*a* charged into the concave portion 14*a* or 14*b*. Thus, each edge portion 20, at which a bottom surface 18 of the concave portion 14*a* or 14*b* and the corresponding side surface of the dielectric ceramic block 2 intersect with each other, is covered with a thick layer. As a result, the thicknesses of the layers of the conductive materials 16*a* and 16*b* will not and do not decrease at the edge portions due to the surface tensions of the conductive materials 16*a* and 16*b*. Therefore, a desired layer thickness can be obtained. In addition, a conductive material in the form of paste—which serves as the inner conductor 5—is applied onto the inner surfaces of the through-holes 4*a*, 4*b*, and 4*c*, as well as onto the inner surface of the counterbores 8, by means of vacuum suction or the like.

Subsequently, the dielectric ceramic block 2 carrying the conductive materials is baked at a predetermined temperature. In the end product, as shown in FIG. 13, the conductive material 16*b* forms the outer conductor 7 on the outer surface of the dielectric ceramic block 2, and the conductive material 16*a* forms the auxiliary conductors 11*a* and 11*b* within the concave portions 14*a* and 14*b* of the open end surface 6 such that the outer ends of the auxiliary conductors 11*a* and 11*b* are in electrical communication with portions of the outer conductor 7 located on the opposite side surfaces of the dielectric ceramic block 2. As a result of the steps described above, the dielectric filter 1E shown in FIG. 13 is produced.

In the dielectric filter 1E of the present embodiment, as described above, the conductive material 16*a* in the form of paste is charged into the concave portions 14*a* and 14*b*—which, of course, are of the same pattern as the auxiliary conductors 11*a* and 11*b* and are formed on the open end surface 6—to a thickness corresponding to the depth of the concave portions 14*a* and 14*b*, such that the outer end surface 17 of the layer of the conductive material 16*a* becomes flush with the corresponding side surfaces of the dielectric ceramic block 2, and the conductive material 16*b* in the form of paste is applied onto the outer surface of the dielectric ceramic block 2, such that a layer of the conductive material 16*b* formed on each side surface of the dielectric ceramic block 2 is connected to the corresponding outer end surface 17 of the layer of the conductive material 16*a* over a relatively large area. Thus, each edge portion 20, at which a bottom surface 18 of the concave portion 14*a* or 14*b* intersects with the corresponding side surface 19 of the dielectric ceramic block 2, is covered with the layers of the conductive materials 16*a* and 16*b* each of a desired thickness. Accordingly, the layers at the edge portion 20 will each attain a desired level of strength during the subsequent baking step. Thus, electrode breakage is prevented which would otherwise occur at the edge portion 20 due to differences in the thermal expansion coefficient of the dielectric ceramic block 2 and the conductive materials 16*a* and 16*b*.

The dielectric filter of the present embodiment provides the following advantages, in addition to those provided by the dielectric filter of the first embodiment. As described above, in the formation of the auxiliary conductors 11*a* and 11*b*, the conductive material 16*a* in the form of paste is charged into the concave portions 14*a* and 14*b* formed on the open end surface 6. Since the shape of the conductive material 16*a* is defined by the concave portions 14*a* and 14*b*, i.e., flow of the conductive material 16*a* is restricted by the concave portions 14*a* and 14*b*, the conductive material 16*a* neither runs nor spreads. Further, because the auxiliary conductor 11*a* and 11*b* can be accurately formed such that the above-described insulating gaps s and s' are of an intended size and the arcuate edge portion of the auxiliary conductor 11*a* surrounding the resonator 3*b* is of an intended length, a desired capacitance C can be reliably obtained. In addition, because the auxiliary conductors 11*a* and 11*b* have a thickness corresponding to the depth of the concave portions 14*a* and 14*b*, the end surfaces of the auxiliary conductors 11*a* and 11*b* facing the resonator 3*b* each have a larger area as compared with the first embodiment, and a larger capacitance C can be obtained.

A Sixth Embodiment

Figure 18:
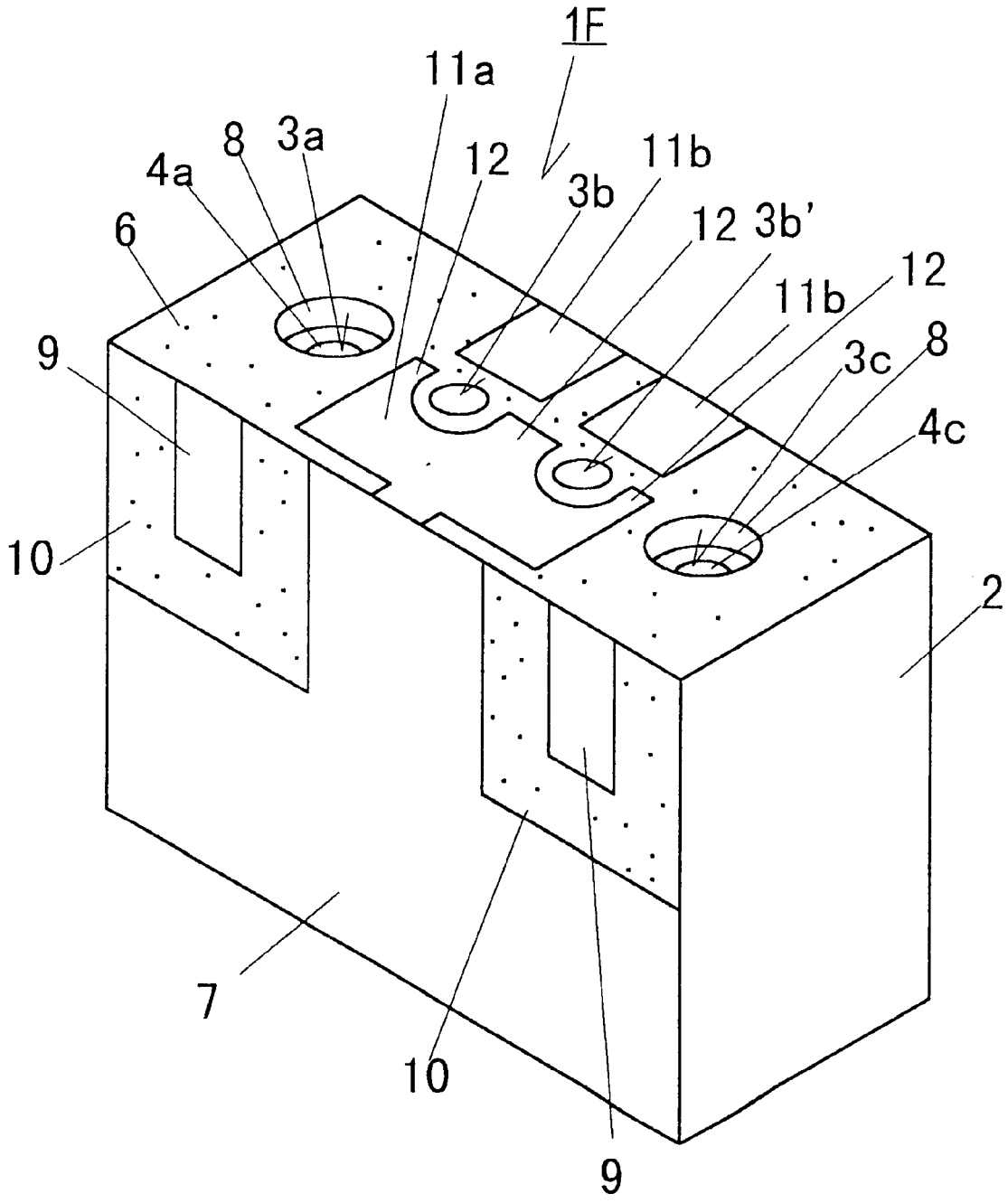
FIG. 18 is a perspective view of a dielectric filter according to a sixth embodiment of the present invention.
Figure 19:
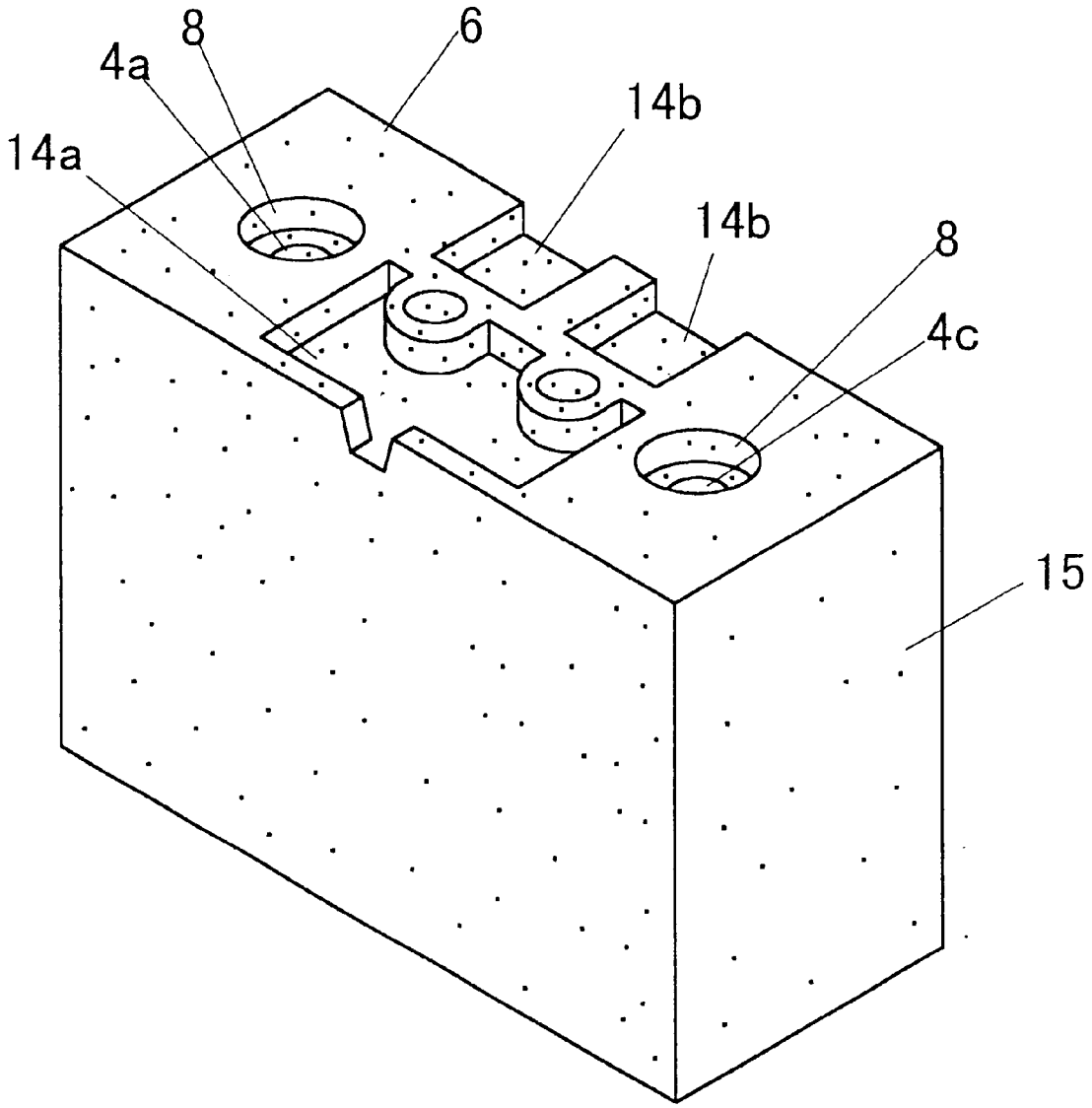
FIG. 19 is a perspective view of a green body obtained through press-forming of ceramic powder and used in the production of the dielectric filter of FIG. 18.

FIGS. 18 and 19 show a four-stage dielectric filter 1F according to a sixth embodiment of the present invention. Because the dielectric filter 1F is of a structure similar to that of the second embodiment, the structure of the dielectric filter 1F will not be described in detail. The first auxiliary conductor 11*a* and the second conductors 11*b* are formed through a process in which concave portions 14*a* and 14*b* having patterns corresponding to those of the auxiliary conductors 11*a* and 11*b* are formed on the open end surface 6 (see FIG. 19), and a conductive material is charged into the concave portions 14*a* and 14*b*. Thus, as in the first embodiment, electrode breakage can be prevented which would otherwise occur at an edge portion at which the first auxiliary conductor 11*a*, or the second auxiliary conductors 11*b*, are connected to the outer conductor 7. In addition, the first auxiliary conductor 11*a* and the second auxiliary conductors 11*b* can be accurately formed so as to obtain a desired capacitance C, and an increased capacitance C can be produced. In addition to these advantages, the dielectric filter of the present embodiment provides the same advantages as those provided by the second embodiment.

Although the invention has been described above in relation to preferred embodiments thereof, it will be understood by those skilled in the art that variations and modifications can be effected in these preferred embodiments without departing from the scope and spirit of the invention.

What is claimed is:

1. A dielectric filter including at least three resonators, said filter comprising:

a dielectric ceramic block having at least three through-holes formed therein, in parallel, in a group having opposite ends, each of said through-holes including an inner surface, and said at least three through-holes including end through-holes located at opposite ends of the group and at least one intermediate through-hole located between said end through-holes, the dielectric ceramic block including an open end surface at which one end of each of said through-holes opens;

an inner conductor covering the inner surface of each of the through-holes to respectively form corresponding end resonators and at least one intermediate resonator;

an outer conductor covering a predetermined outer surface of the dielectric ceramic block, excluding said open end surface; and input/output pads formed on one side surface of the dielectric ceramic block such that the pads are located near the open end surface and face said end resonators so as to be capacatively coupled thereto, each of the end through-holes including a counterbore formed at one end of the corresponding end through-hole and opening at the open end surface such that the corresponding end through-hole is of increased diameter at said one end; and said filter further comprising an auxiliary conductor disposed on the open end surface so as to face said at least one intermediate resonator, the auxiliary conductor being of forked shape and having at least two branch portions, each of said branch portions being located between adjacent resonators and the auxiliary conductor at least partially surrounding the at least one intermediate resonator with an insulating gap formed therebetween, and said auxiliary conductor being connected to a portion of the outer conductor located on said one side surface on which the input/output pads are formed.

2. A dielectric filter according to claim 1, wherein the auxiliary conductor has an opening therein which opens toward an opposite side surface of the ceramic block opposite to said one side surface on which the input/output pads are formed; and a second auxiliary conductor extends toward said opening from a portion of the outer conductor located on said opposite side surface such that the inner edge of the second auxiliary conductor faces, and is spaced from, the corresponding resonator with an insulating gap formed therebetween.

3. A dielectric filter according to claim 1, wherein a trap resonator is disposed at one end of the dielectric ceramic block adjacent to at least one of the end resonators, the trap resonator including a through-hole having an inner surface covered with an inner conductor, and a counterbore being formed at one end of the through-hole of the trap resonator which opens at the open end surface such that said through-hole of said trap resonator is of an increased diameter at said one end.

4. A dielectric filter according to claim 2, wherein a trap resonator is disposed at one end of the dielectric ceramic block adjacent to at least one-of the end resonators, the trap resonator including a through-hole having an inner surface covered with an inner conductor, and a counterbore being formed at one end of the through-hole of the trap resonator which opens at the open end surface such that said through-hole of said trap resonator is of an increased diameter at said one end.

5. A dielectric filter as claimed in claim 1 wherein said portion of said outer conductor to which said auxiliary conductor is connected is electrically isolated from said input/output pads on said one side surface by exposed, nonconductive portions of said dielectric ceramic block.

6. A dielectric filter as claimed in claim 1 wherein parts of said branch portions which are disposed between the at least one intermediate resonator and an associated adjacent resonator extend substantially orthogonally to an adjacent edge of said one side surface.

* * * * *